US010414165B2

(12) United States Patent
Nishida et al.

(10) Patent No.: US 10,414,165 B2
(45) Date of Patent: Sep. 17, 2019

(54) PRINT DEVICE AND NON-TRANSITORY COMPUTER-READABLE MEDIUM

(71) Applicant: BROTHER KOGYO KABUSHIKI KAISHA, Nagoya (JP)

(72) Inventors: Katsunori Nishida, Toyoake (JP); Yoshinori Kato, Nagoya (JP)

(73) Assignee: BROTHER KYOGO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/716,769

(22) Filed: Sep. 27, 2017

(65) Prior Publication Data

US 2018/0281437 A1 Oct. 4, 2018

(30) Foreign Application Priority Data

Mar. 31, 2017 (JP) ..... 2017-072948

(51) Int. Cl.
*B41J 2/165* (2006.01)
*B41J 2/175* (2006.01)
(Continued)

(52) U.S. Cl.
CPC ..... *B41J 2/17566* (2013.01); *B41J 2/125* (2013.01); *B41J 2/16505* (2013.01);
(Continued)

(58) Field of Classification Search
CPC ..... B41J 2/17566; B41J 2/17546; B41J 2/17509; B41J 2/1752; B41J 2/18;
(Continued)

(56) References Cited

U.S. PATENT DOCUMENTS 6,234,597 B1 * 5/2001 Suzuki ..... B41J 2/175 347/19
9,427,971 B2 8/2016 Kobayashi
(Continued)

FOREIGN PATENT DOCUMENTS

JP H11-334093 A 12/1999
JP H11-334104 A 12/1999
(Continued)

OTHER PUBLICATIONS

Notification of Reasons for Rejection issued in connection with related Japanese Patent Application No. 2017-072948, dated Mar. 5, 2019. (8 pages).

*Primary Examiner* — Yaovi M Ameh
(74) *Attorney, Agent, or Firm* — K&L Gates LLP

(57) ABSTRACT

A processor of a print device performs empty processing in a case where it has determined that it has received, from a remaining ink amount detector, a first signal that indicates that a remaining amount of an ink is not greater than a first prescribed amount. The processor also performs the empty processing in a case where it has not determined that it has received the first signal, but has determined that it has received a second signal. In the empty processing, the processor performs soak cleaning of a nozzle face and stores an empty soak standby flag in an EEPROM. The empty soak standby flag is a flag that prohibits the performing of a printing operation. Therefore, the print device is able to reduce the possibility that a decline in print quality will occur.

11 Claims, 14 Drawing Sheets

(51) Int. Cl.

| | |
|---|---|
| ***B41J 2/125*** | (2006.01) |
| ***B41J 2/18*** | (2006.01) |
| ***B41J 29/02*** | (2006.01) |
| ***B41J 29/13*** | (2006.01) |
| *B41J 3/407* | (2006.01) |

(52) U.S. Cl.
CPC ..... *B41J 2/16508* (2013.01); *B41J 2/16523* (2013.01); *B41J 2/16552* (2013.01); *B41J 2/1752* (2013.01); *B41J 2/17509* (2013.01); *B41J 2/17546* (2013.01); *B41J 2/18* (2013.01); *B41J 29/02* (2013.01); *B41J 29/13* (2013.01); *B41J 3/4078* (2013.01); *B41J 2002/17573* (2013.01); *B41J 2002/17589* (2013.01)

(58) Field of Classification Search
CPC ..... B41J 2/16508; B41J 29/13; B41J 29/02; B41J 2/16552; B41J 2/16523; B41J 2/125; B41J 2/16505; B41J 2002/17589; B41J 2002/17573; B41J 3/4078
See application file for complete search history.

(56) References Cited

U.S. PATENT DOCUMENTS

2011/0242202 A1* 10/2011 Saeki ..... B41J 2/16538 347/23
2016/0031222 A1* 2/2016 Kobayashi ..... B41J 2/16508 347/28

FOREIGN PATENT DOCUMENTS

| | | | |
|---|---|---|---|
| JP | 2000062213 | A | 2/2000 |
| JP | 2004-167430 | A | 6/2004 |
| JP | 2013-075398 | A | 4/2013 |
| JP | 2015-085660 | A | 5/2015 |
| JP | 2016-030382 | A | 3/2016 |
| JP | 2016-144911 | A | 8/2016 |

* cited by examiner

PRINT DEVICE AND NON-TRANSITORY COMPUTER-READABLE MEDIUM

CROSS-REFERENCE TO RELATED APPLICATION

This application claims priority to Japanese Patent Application No. 2017-72948 filed Mar. 31, 2017. The contents of the foregoing application are hereby incorporated herein by reference.

BACKGROUND

The present disclosure relates to a print device and a non-transitory computer-readable medium.

An inkjet printer is known that performs a maintenance operation that cleans a nozzle face of a print head. When performing the maintenance operation, the inkjet printer covers the nozzle face with a cap and operates a suction device to draw ink out of nozzles that are provided in the nozzle face. Next, the inkjet printer injects a cleaning liquid into the cap. The nozzle face is thus cleaned.

SUMMARY

In order to reduce the adverse effects of ink that has adhered to the nozzle face and hardened, the inkjet printer draws the ink out of the nozzles after a specified period of time has elapsed since printing was last completed. Thereafter, the cleaning liquid is injected into the cap, and with the cap filled with the cleaning liquid, the nozzle face is thought to be left in a state in which it is soaked by the cleaning liquid. However, in a case where none of the cleaning liquid remains, the nozzle face is not left in a state in which it is soaked by the cleaning liquid, which creates the possibility that adverse effects will occur, such as the clogging of a flow path for the maintenance operation, or the clogging of the nozzles by hardened ink, such that some dots are not printed the next time printing is performed. A decline in the print quality may therefore occur.

Embodiments of the broad principles derived herein provide a print device and a non-transitory computer-readable medium that are able to reduce the possibility that a decline in the print quality will occur.

The embodiments herein provide a print device that includes a head that is provided with a nozzle face, in which is disposed a nozzle that discharges an ink. The print device also includes an ink storage portion that stores the ink and is connected to the head through an ink supply path. The print device also includes a remaining ink amount detector that detects a remaining amount of the ink that is stored in the ink storage portion. The print device also includes a cap that can contact the nozzle face and cover the nozzle. The print device also includes a cleaning liquid storage portion that stores a cleaning liquid for cleaning the nozzle face, the cleaning liquid storage portion being connected to the cap through a cleaning liquid supply flow path. The print device also includes a remaining cleaning liquid amount detector that detects a remaining amount of the cleaning liquid stored in the cleaning liquid storage portion. The print device also includes a waste liquid flow path that is connected to the cap and can drain off the cleaning liquid that has been supplied to the inside of the cap. The print device also includes a processor and a memory that stores computer-readable instructions which, when executed by the processor, perform processes including first determination processing, second determination processing, and empty processing. The first determination processing determines whether a first signal has been received from the remaining ink amount detector, the first signal indicating that the remaining amount of the ink is not greater than a first prescribed amount. The second determination processing determines whether a second signal has been received from the remaining cleaning liquid amount detector. The second signal indicates that the amount of the remaining cleaning liquid is less than a specified amount and is not less than a second prescribed amount that is necessary in order to perform one round of nozzle face soak cleaning processing. In the nozzle face soak cleaning processing, with the cap in a covering state in which it covers the nozzle face, the cleaning liquid is put into a state in which it fills the cap and soaks the nozzle face. The empty processing is performed in a case where the first determination processing has determined that the first signal has been received. The empty processing is also performed in a case where the second determination processing has determined that the second signal has been received. The empty processing performs the nozzle face soak cleaning processing and print prohibition processing, which prohibits a printing operation.

The embodiments herein also provide a non-transitory computer readable medium storing computer readable instructions, which are executed by a processor of a print device. The print device is provided with a head that is provided with a nozzle face, in which is disposed a nozzle that discharges an ink. The print device is also provided with an ink storage portion that stores the ink and is connected to the head through an ink supply path. The print device is also provided with a remaining ink amount detector that detects a remaining amount of the ink that is stored in the ink storage portion. The print device is also provided with a cap that can contact the nozzle face and cover the nozzle. The print device is also provided with a cleaning liquid storage portion that stores a cleaning liquid for cleaning the nozzle face, the cleaning liquid storage portion being connected to the cap through a cleaning liquid supply flow path. The print device is also provided with a remaining cleaning liquid amount detector that detects a remaining amount of the cleaning liquid stored in the cleaning liquid storage portion. The print device is also provided with a waste liquid flow path that is connected to the cap and can drain off the cleaning liquid that has been supplied to the inside of the cap. The processor is configured to control the print device, and the computer-readable instructions, when executed by the processor, perform processes including first determination processing, second determination processing, and empty processing. The first determination processing determines whether a first signal has been received from the remaining ink amount detector, the first signal indicating that the remaining amount of the ink is not greater than a first prescribed amount. The second determination processing determines whether a second signal has been received from the remaining cleaning liquid amount detector. The second signal indicates that the amount of the remaining cleaning liquid is less than a specified amount and is not less than a second prescribed amount that is necessary in order to perform one round of nozzle face soak cleaning processing. In the nozzle face soak cleaning processing, with the cap in a covering state in which it covers the nozzle face, the cleaning liquid is put into a state in which it fills the cap and soaks the nozzle face. The empty processing is performed in a case where the first determination processing has determined that the first signal has been received. The empty processing is also performed in a case where the second determination processing has determined that the second signal has been received. The empty processing performs the nozzle face soak cleaning processing and print prohibition processing, which prohibits a printing operation.

BRIEF DESCRIPTION OF THE DRAWINGS

Embodiments will be described below in detail with reference to the accompanying drawings in which.

DETAILED DESCRIPTION

Figure 1:
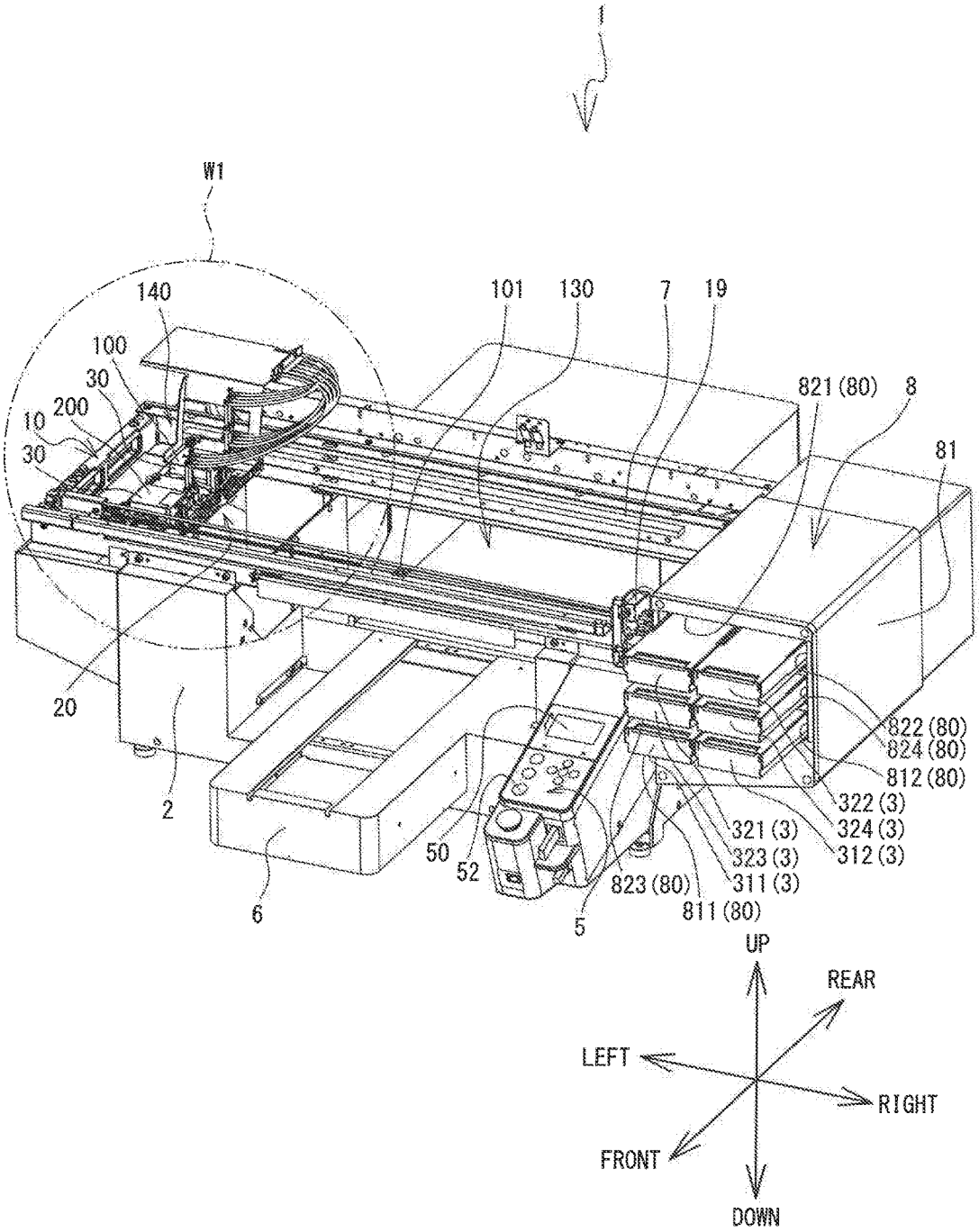
FIG. 1 is an oblique view of a printer.

The overall configuration of a printer 1 will be explained with reference to FIGS. 1 to 5. In the explanation that follows, the terms left, right, front, rear, up, and down that are used are those indicated by the arrows in the drawings.

As shown in FIG. 1, the printer 1 is an inkjet printer that prints by discharging an ink that is an example of a liquid onto a cloth such as a T-shirt or the like that is a printing medium (not shown in the drawings). The printing medium may also be a paper or the like. The printer 1 can print a color image on the printing medium by discharging downward five different types of the ink (white, black, yellow, cyan, and magenta), for example. In the explanation that follows, among the five different types of the ink, the ink that is white will be called the white ink. The other four types of the ink, black, cyan, yellow, and magenta, will be collectively called the color inks. When the white ink and the color inks are referenced collectively, as well as when no one ink is specified, they will be called simply the ink.

When the color of the printing medium is mainly a dark color, the printer 1 prints by discharging the white ink as a base coat over all or a portion of the printing area. The printer 1 discharges the color inks after it has discharged the white ink. The white ink is a liquid that contains components that are more prone to sedimentation than are the components that the color inks contain. The components that are prone to sedimentation are white pigment particles, such as titanium oxide, for example. Titanium oxide is an inorganic pigment with a comparatively high specific gravity. Therefore, when the printer 1 prints using the white ink, it is necessary to maintain the good flowability of the white ink by keeping the white ink sufficiently agitated in the white ink flow path.

Figure 2:
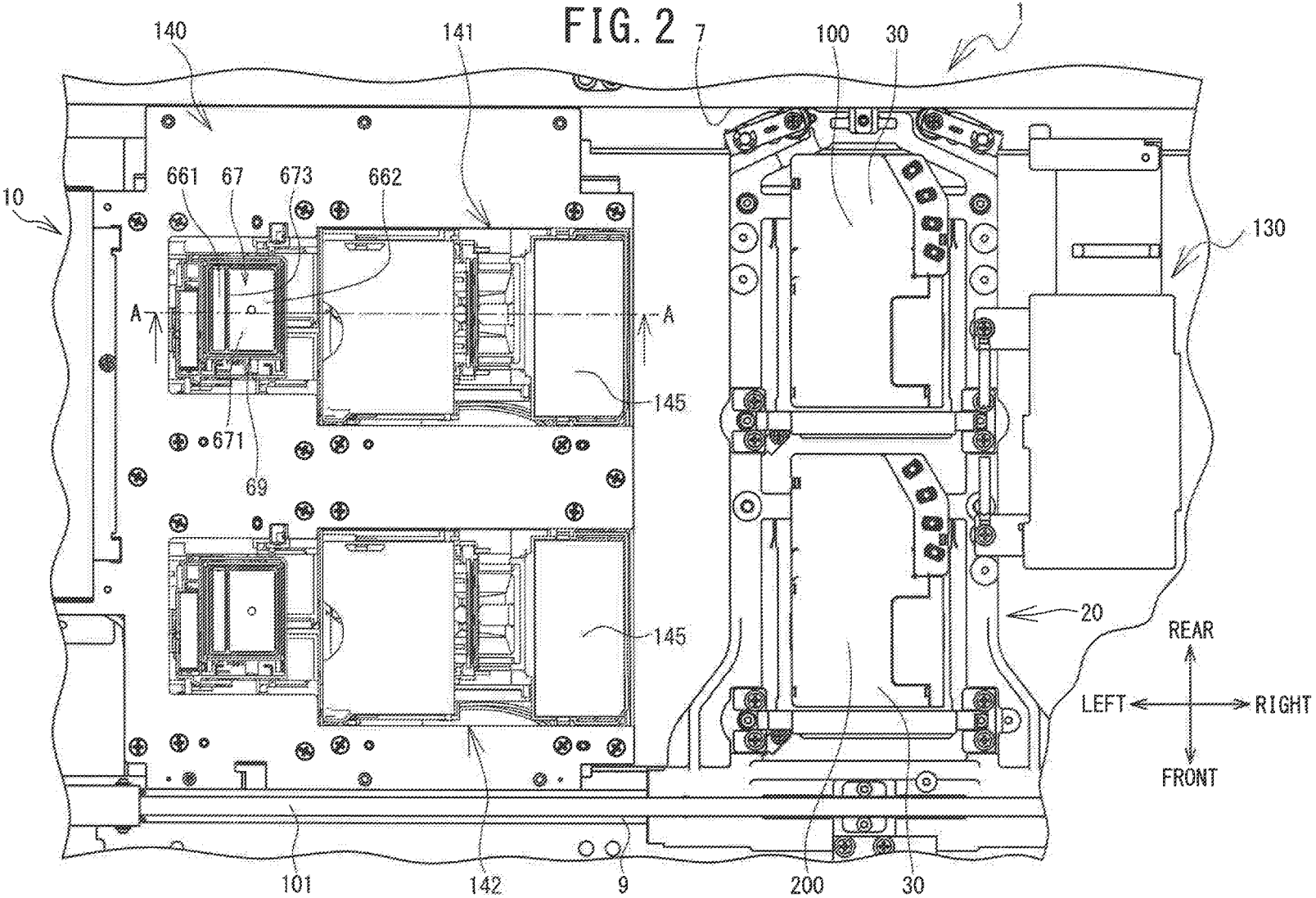
FIG. 2 is a plan view of the printer.
Figure 3:
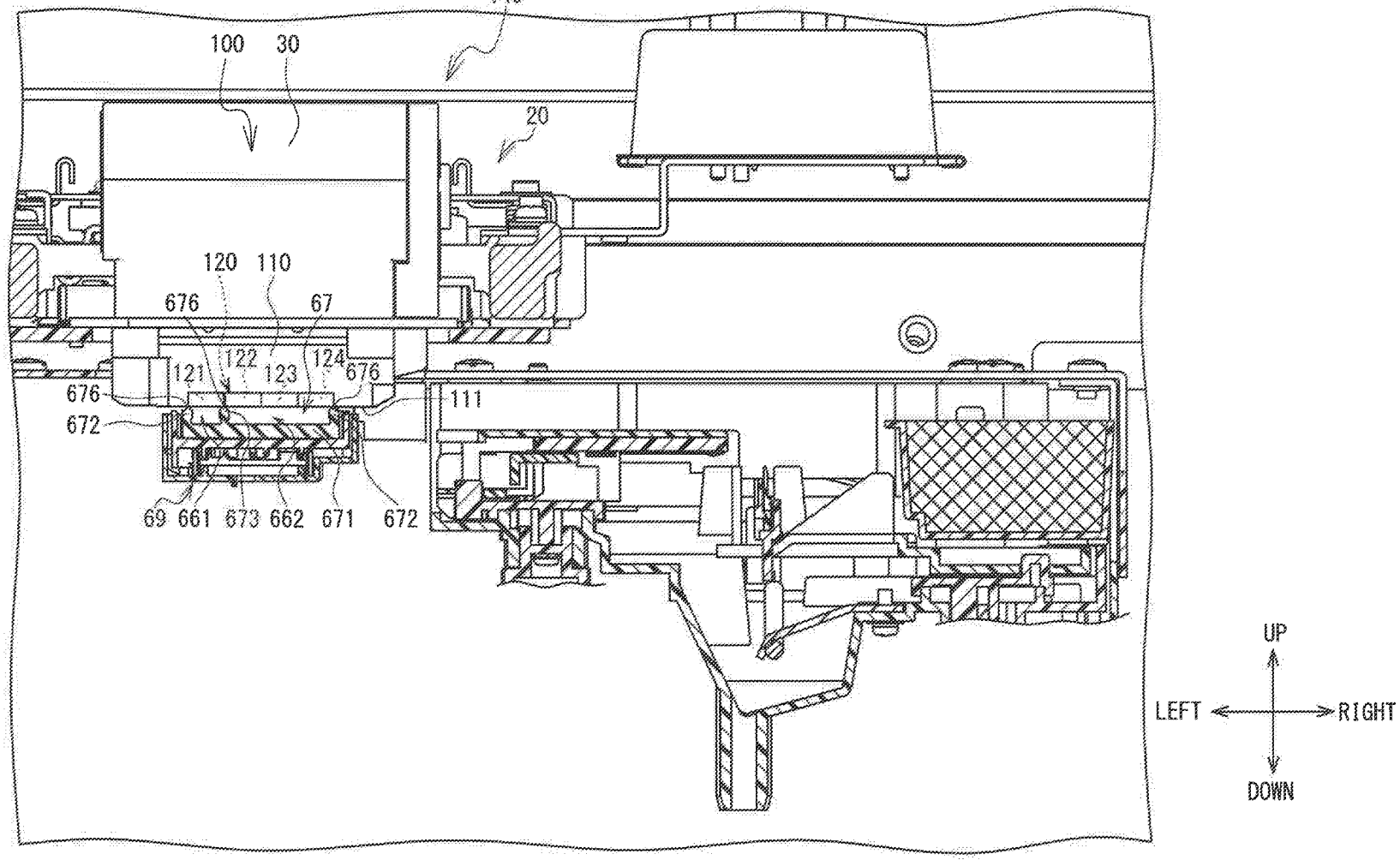
FIG. 3 is a section view of a head unit along the line A-A in FIG. 2, when the head unit has moved to a position above a cap.

As shown in FIGS. 1 to 3, the printer 1 is provided with a housing 2, a frame body 10, a shaft 9, a rail 7, a carriage 20, head units 100, 200, a drive belt 101, a drive motor 19, a platen drive mechanism 6, a mounting frame portion 8, and, in a non-printing area 140, maintenance portions 141, 142.

An operation portion 5 of the printer 1 is located on the right front side of the housing 2. The operation portion 5 is provided with a display 50 and operation buttons 52. An operator operates the operation buttons 52 when inputting commands that pertain to various operations of the printer 1.

The top portion of the housing 2 holds the frame body 10, which is substantially rectangular in a plan view. The front side of the frame body 10 supports the shaft 9 (refer to FIG. 2). The rear side of the frame body 10 supports the rail 7. The shaft 9 extends from left to right on the inner side of the frame body 10. The rail 7 is disposed opposite the shaft 9 and extends from left to right.

Figure 4:
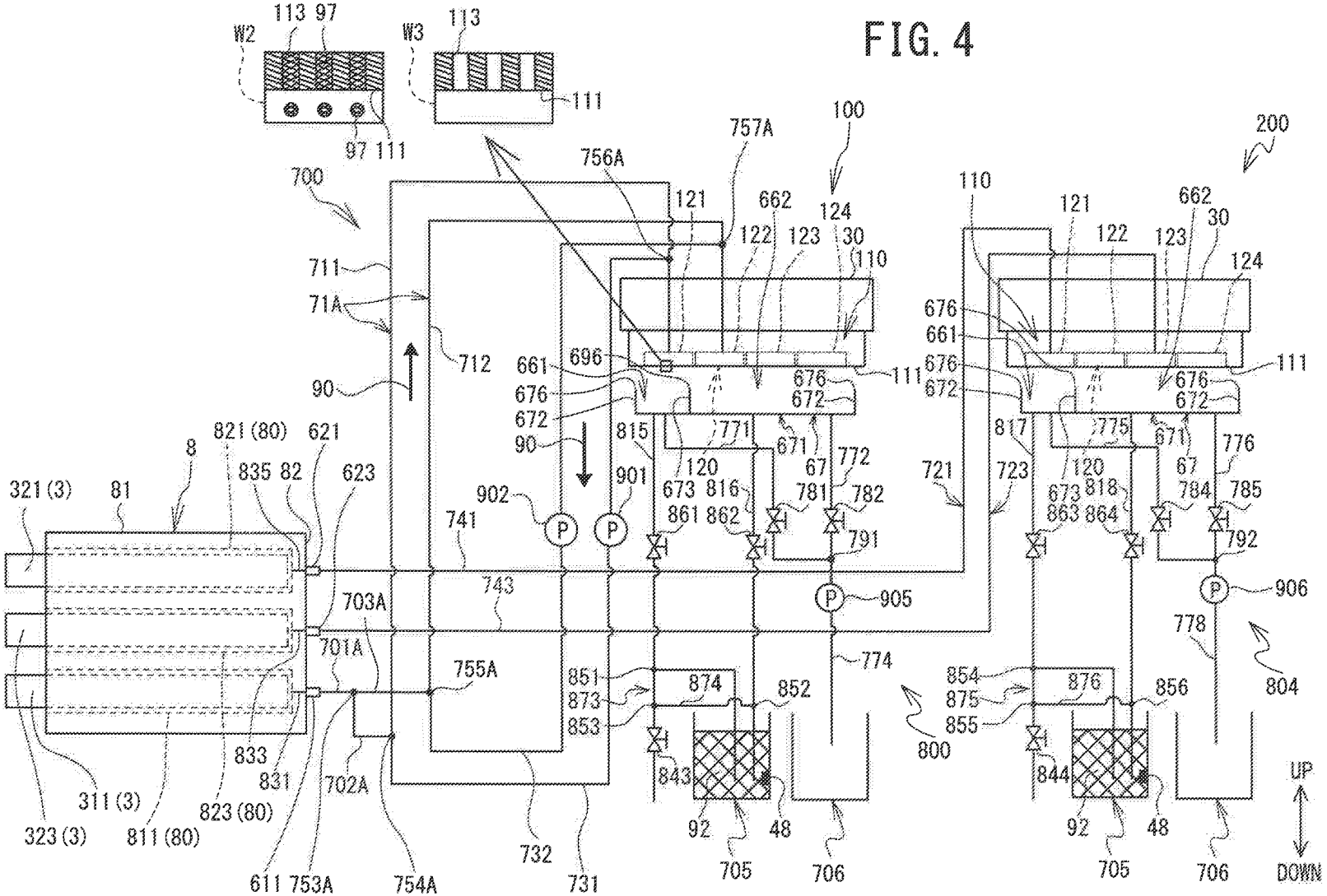
FIG. 4 is a schematic diagram that shows a portion of an ink flow path system.
Figure 5:
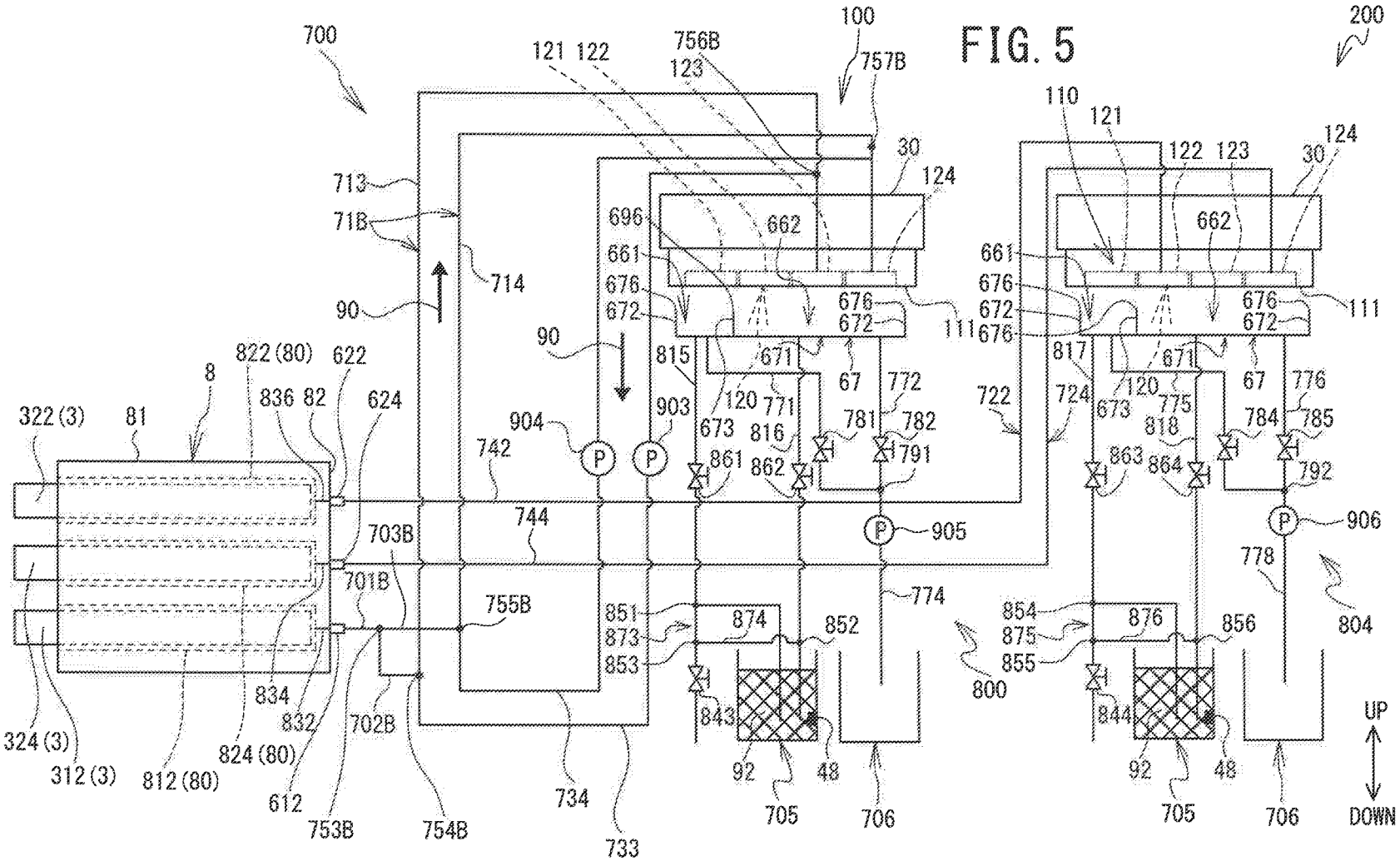
FIG. 5 is a schematic diagram that shows another portion of the ink flow path system.

The carriage 20 can be conveyed to the left and the right along the shaft 9. As shown in FIGS. 1 and 2, the head units 100, 200 are carried on the carriage 20 and are arrayed in the front-rear direction. The head unit 100 is disposed to the rear of the head unit 200. As shown in FIGS. 1 to 3, the head units 100, 200 are each provided with a housing 30. As shown in FIG. 3, the bottom portion of the housing 30 of the head unit 100 supports a head 110. The bottom portion of the head unit 200 is configured in the same manner as that of the head unit 100. FIGS. 4 and 5 show the positions, in the up-down direction, of various members that configure the ink flow paths in the interior of the printer 1. FIGS. 4 and 5 show the head units 100, 200, as seen from the front, arrayed left to right on the page. The head 110 of the head unit 100 discharges the white ink. The head 110 of the head unit 200 discharges the color inks.

The head 110 is provided with a nozzle face 111 (refer to FIG. 3). The nozzle face 111 is a face that has a plurality of tiny nozzles 113 (refer to FIG. 4) that are capable of discharging the inks downward. The nozzle face 111 is a flat surface that extends in the left-right direction and the front-rear direction. The head units 100, 200 each have the nozzle face 111 on their bottom faces. The plurality of the nozzles 113 in the nozzle face 111 are disposed in a nozzle disposition area 120. The nozzle disposition area 120 is disposed in the center of the left-right direction of the nozzle face 111. The nozzle disposition area 120 extends in the front-rear direction.

As shown in FIG. 3, the nozzle face 111 has nozzle arrays 121 to 124. Each one of the nozzle arrays 121 to 124 is an array of a plurality of the nozzles 113. The nozzle arrays 121 to 124 are disposed in four separate areas in the left-right direction of the nozzle disposition area 120. The nozzle arrays 121 to 124 are arrayed as the nozzle array 121, the nozzle array 122, the nozzle array 123, and the nozzle array 124, in that order from left to right.

As shown in FIGS. 4 and 5, the nozzle arrays 121, 122 of the head unit 100 are connected to a single cartridge 311 (refer to FIGS. 1 and 4), which stores the white ink. The nozzle arrays 123, 124 are connected to another single cartridge 312 (refer to FIGS. 1 and 5), which stores the white ink.

The nozzle arrays 121 to 124 of the head unit 200 can respectively be connected to cartridges 321 to 324, which store the color inks. In the head unit 200, the nozzle array 121 is connected to the black ink cartridge 321 (refer to FIGS. 1 and 4). The nozzle array 122 is connected to the yellow ink cartridge 322 (refer to FIGS. 1 and 5). The nozzle array 123 is connected to the cyan ink cartridge 323 (refer to FIGS. 1 and 4). The nozzle array 124 is connected to the magenta ink cartridge 324 (refer to FIGS. 1 and 5).

As shown in FIG. 1, the drive belt 101 spans the inner side of the frame body 10 in the left-right direction. The drive motor 19 is coupled to the carriage 20 through the drive belt 101. As the drive motor 19 drives the drive belt 101, the carriage 20 moves reciprocally to the left and the right along the shaft 9.

The platen drive mechanism 6 is provided with a pair of guide rails (not shown in the drawings) and a platen (not shown in the drawings). The pair of the guide rails extend in the front-rear direction on the inner side of the platen drive mechanism 6 and support the platen. The platen is able to move toward the front and the rear along the pair of the guide rails. The platen has a plate shape that is substantially rectangular in a plan view, with its long axis extending in the front-rear direction. The platen is disposed below the frame body 10. The top portion of the platen holds the printing medium. The platen drive mechanism 6 moves the platen toward the front and the rear, with a motor (not shown in the drawings) serving as the drive source. The platen therefore conveys the printing medium in the front-rear direction (an auxiliary scanning direction). The head 110, which moves reciprocally in the left-right direction (a main scanning direction), performs printing on the printing medium by discharging the inks.

As shown in FIG. 1, the mounting frame portion 8 is disposed on the right side of the housing 2. A housing 81 that supports the mounting frame portion 8 has a substantially three-dimensional rectangular shape, with its long axis extending in the front-rear direction. The mounting frame portion 8 is provided with a plurality of mounting portions 80, in which a plurality of cartridges 3 (311, 312, 321, 322, 323, and 324) can be mounted. Each one of the mounting portions 80 is a recessed portion that is recessed toward the rear from the front face of the mounting frame portion 8. Draw-out needles 831 to 836 (refer to FIGS. 4 and 5), which have hollow needle shapes, are provided on the inner side of the rear ends of the plurality of the mounting portions 80. When the cartridges 3 are mounted in the mounting portions 80, the draw-out needles 831 to 836 pierce rubber plugs (not shown in the drawings) in ink containing bodies (not shown in the drawings) that are contained in the cartridges 3. The inks that the draw-out needles 831 to 836 draw out flow to the heads 110.

As shown in FIGS. 1, 4, and 5, the plurality of the mounting portions 80 are provided with upper mounting portions 821 to 824 and lower mounting portions 811, 812. The upper mounting portions 821 to 824 are located in the upper portion of the mounting frame portion 8. The lower mounting portions 811, 812 are positioned lower than the upper mounting portions 821 to 824. The cartridges 311, 312, which contain the white ink, can be mounted in the lower mounting portions 811, 812, respectively. The cartridges 321 to 324, which contain the color inks, can be mounted in the upper mounting portions 821 to 824, respectively.

As shown in FIGS. 1 and 2, along the paths that the head units 100, 200 travel, the area where the head units 100, 200 perform the printing is a printing area 130. The area along the paths that the head units 100, 200 travel that is not in the printing area 130 is the non-printing area 140. The non-printing area 140 is an area in the left end portion of the printer 1. The printing area 130 is the area from the right edge of the non-printing area 140 to the right end of the printer 1. The platen is disposed in the printing area 130, below the paths that the head units 100, 200 travel.

As shown in FIG. 2, the maintenance portions 141, 142 are disposed in the non-printing area 140, below the travel paths of the head units 100, 200, respectively. Maintenance operations such as purging and the like, are performed by the maintenance portions 141, 142 in order to restore the ink discharge performance of the head units 100, 200 and ensure the printing quality of the printer 1.

As shown in FIGS. 2 and 3, the maintenance portion 141 is provided with a cap 67 and the like. The cap 67 is located in the left portion of the maintenance portion 141. The cap 67 is made of a synthetic resin such as silicon rubber or the like, for example, and it is provided with a bottom wall 671, a perimeter wall 672, and a partition wall 673. The partition wall 673 divides the area inside the perimeter wall 672 into two parts. In the explanation that follows, the area inside the perimeter wall 672 that is to the left of the partition wall 673 will be called the first area 661. The area that is to the right of the partition wall 673 will be called the second area 662. The cap 67 is moved up and down by operation of a motor, a gear, and the like that are not shown in the drawings. As shown in FIG. 3, when the head unit 100 has moved into the non-printing area 140 and the cap 67 has moved upward, an upper edge 676 of the perimeter wall 672 seals the perimeter of the nozzle disposition area 120 of the nozzle face 111 of the head unit 100. The cap 67 therefore covers the plurality of the nozzles 113. An upper edge 676 of the partition wall 673 seals the boundary between the nozzle array 121 and the nozzle arrays 122 to 124. In the explanation that follows, when the cap 67 is sealing the nozzle face 111, the position of the cap 67 and a cap support portion 69 will be called the covering position. When the cap 67 is not sealing the nozzle face 111, the position of the cap 67 and the cap support portion 69 will be called the cap withdrawn position.

An ink flow path system 700 will be explained with reference to FIGS. 4 and 5. In order to make the drawings easy to understand, FIGS. 4 and 5 show the ink flow path system 700, the heads 110, and the caps 67 schematically. As shown in FIGS. 4 and 5, the ink flow path system 700 is provided with first flow paths 71A, 71B and second flow paths 721 to 724. FIG. 4 shows the flow paths that are connected to the lower mounting portion 811 and the upper mounting portions 821, 823 (refer to FIG. 1). FIG. 5 shows the flow paths that are connected to the lower mounting portion 812 and the upper mounting portions 822, 824 (refer to FIG. 1).

The first flow paths 71A, 71B are flow paths that connect the lower mounting portions 811, 812, respectively, to the head 110 of the head unit 100. The first flow paths 71A, 71B are the flow paths through which the white ink flows. The second flow paths 721 to 724 are flow paths that connect the upper mounting portions 821 to 824, respectively, to the head 110 of the head unit 200. The second flow paths 721 to 724 are the flow paths through which the color inks flow.

As shown in FIG. 4, the first flow path 71A is provided with the draw-out needle 831, an ink supply outlet 611, a draw-out flow path 701A, connecting flow paths 702A, 703A, a branching portion 753A, connection portions 754A, 755A, first supply flow paths 711, 712, circulation flow paths 731, 732, and pumps 901, 902. The draw-out flow path 701A, the connecting flow paths 702A, 703A, the first supply flow paths 711, 712, and the circulation flow paths 731, 732 are configured from tubes.

The ink supply outlet 611 is located in the mounting frame portion 8. The draw-out needle 831 is located in the lower mounting portion 811. The ink supply outlet 611 supplies the white ink that the draw-out needle 831 draws out to the draw-out flow path 701A. The draw-out flow path 701A is the flow path that is connected to the ink supply outlet 611.

The branching portion 753A is located at the end of the draw-out flow path 701A that is closer to the head 110. The branching portion 753A connects the draw-out flow path 701A to one end of each of two flow paths, the connecting flow path 702A and the connecting flow path 703A. The connection portions 754A, 755A respectively connect the other ends of the connecting flow paths 702A, 703A to the first supply flow paths 711, 712, respectively.

The first supply flow paths 711, 712 are respectively connected to the nozzle arrays 121, 122 of the head unit 100, and they supply to the head 110 of the head unit 100 the white ink that flows through the draw-out flow path 701A and the connecting flow paths 702A, 703A.

The circulation flow path 731 is connected to the first supply flow path 711 at a connection portion 756A, which is located outside the head unit 100. The circulation flow path 732 is connected to the first supply flow path 712 at a connection portion 757A, which is located outside the head unit 100. The opposite ends of the circulation flow paths 731, 732 from the connection portions 756A, 757A, that is, the ends that are closer to the respective mounting portions 80, are respectively connected to the first supply flow paths 711, 712 at the connection portions 754A, 755A, respectively. Therefore, in circulation processing, the white ink circulates through the first supply flow paths 711, 712 and the circulation flow paths 731, 732 without circulating inside the head 110. The printer 1 therefore performs outside-the-head circulation (inside-the-supply-path circulation) of the white ink. The circulation flow path 731 is provided with the pump 901. The circulation flow path 732 is provided with the pump 902. In subsequent descriptions, the first supply flow paths 711, 712 and the circulation flow paths 731, 732 are sometimes described as the circulation flow paths.

As shown in FIG. 5, the first flow path 71B is provided with the draw-out needle 832, an ink supply outlet 612, a draw-out flow path 701B, connecting flow paths 702B, 703B, a branching portion 753B, connection portions 754B, 755B, first supply flow paths 713, 714, circulation flow paths 733, 734, drain flow paths 763, 764, and pumps 903, 904. The draw-out flow path 701B, the connecting flow paths 702B, 703B, the first supply flow paths 713, 714, and the circulation flow paths 733, 734 are configured from tubes.

The ink supply outlet 612 is located in the mounting frame portion 8. The draw-out needle 832 is located in the lower mounting portion 812. The ink supply outlet 612 supplies the white ink that the draw-out needle 832 draws out to the draw-out flow path 701B. The draw-out flow path 701B is the flow path that is connected to the ink supply outlet 612.

The branching portion 753B is located at the end of the draw-out flow path 701B that is closer to the head 110. The branching portion 753B connects the draw-out flow path 701B to one end of each of two flow paths, the connecting flow path 702B and the connecting flow path 703B. The connection portions 754B, 755B respectively connect the other ends of the connecting flow paths 702B, 703B to the first supply flow paths 713, 714, respectively.

The first supply flow paths 713, 714 are respectively connected to the nozzle arrays 123, 124 of the head unit 100, and they supply to the head 110 the white ink that flows through the draw-out flow path 701B and the connecting flow paths 702B, 703B.

The circulation flow path 733 is connected to the first supply flow path 713 at a connection portion 756B, which is located outside the head unit 100. The circulation flow path 734 is connected to the first supply flow path 714 at a connection portion 757B, which is located outside the head unit 100. The opposite ends of the circulation flow paths 733, 734 from the connection portions 756B, 757B, that is, the ends that are closer to the respective mounting portions 80, are respectively connected to the first supply flow paths 713, 714 at the connection portions 754B, 755B, respectively. Therefore, in the circulation processing, the white ink circulates through the first supply flow paths 713, 714 and the circulation flow paths 733, 734 without circulating inside the head 110. The printer 1 therefore performs outside-the-head circulation (inside-the-supply-path circulation) of the white ink. The circulation flow path 733 is provided with the pump 903. The circulation flow path 734 is provided with the pump 904. In subsequent descriptions, the first supply flow paths 713, 714 and the circulation flow paths 733, 734 are sometimes described as the circulation flow paths.

The drain flow path 763 is connected to the first supply flow path 713 at the connection portion 763A, which is located in the first supply flow path 713 between the connection portion 756B and the nozzle array 123. The drain flow path 764 is connected to the first supply flow path 714 at the connection portion 764A, which is located in the first supply flow path 714 between the connection portion 757B and the nozzle array 124. The connection portions 763A, 764A are located in the interior of the head unit 100.

The second flow paths 721 to 724, through which the color inks flow, will be explained. As shown in FIGS. 4 and 5, the second flow paths 721 to 724 are flow paths that connect the upper mounting portions 821 to 824, respectively, to the head 110 of the head unit 200. The second flow paths 721 to 724 are provided with the draw-out needles 835, 836, 833, 834, ink supply outlets 621 to 624, and second supply flow paths 741 to 744. The second flow paths 721 to 724 are not provided with structures that are equivalent to the branching portions 753A, 753B, the connecting flow paths 702A, 703A, 702B, 703B, and the circulation flow paths 731 to 734 of the first flow paths 71A, 71B. Therefore, the second flow paths 721 to 724 are also not provided with structures that are equivalent to the connecting flow paths 702A, 703A, 702B, 703B and the pumps 901 to 904 of the first flow paths 71A, 71B. The other structures in the second flow paths 721 to 724 are the same as those in the first flow paths 71A, 71B.

As shown in FIGS. 4 and 5, the first flow paths 71A, 71B and the second flow paths 721 to 724 can be connected to waste liquid flow paths 771 to 778, waste liquid on-off valves 781, 782, 784, 785, pumps 905, 906, and a waste liquid tank 706 through the cap 67. An example will be explained below.

The cap 67 is able to cover the head 110 of the head unit 100. The waste liquid flow paths 771, 772 are respectively connected to the first area 661 and the second area 662 of the cap 67. The waste liquid flow paths 771 and 772 converge at a convergence portion 791 and are connected to the waste liquid tank 706 through the pump 905. The waste liquid tank 706 is a container that stores, outside of the ink flow path system 700, the ink that has flowed out from the cap 67. The pump 905 sucks up the white ink from the cap 67 through the waste liquid flow paths 771 and 772. The waste liquid on-off valves 781, 782 are electromagnetic valves that are located in the waste liquid flow paths 771 and 772, respectively. The pump 905 is selectively connected to the waste liquid flow paths 771 and 772 in accordance with the opening and closing of the electromagnetic valves.

The cap 67 is able to cover the head 110 of the head unit 200. The waste liquid flow paths 775, 776 are respectively connected to the first area 661 and the second area 662 of the cap 67. The waste liquid flow paths 775 and 776 converge at a convergence portion 792 and are connected to the waste liquid tank 706 through the pump 906. The waste liquid tank 706 stores the ink that has flowed out from the cap 67. The pump 906 sucks up the color inks from the cap 67 through the waste liquid flow paths 775 and 776. The waste liquid on-off valves 784, 785 are electromagnetic valves that are located in the waste liquid flow paths 775, 776, respectively. The pump 906 is selectively connected to the waste liquid flow paths 775 and 776 in accordance with the opening and closing of the electromagnetic valves.

If the printer 1 performs the circulation processing when the cap 67 is in the covering position, the operation of the pumps 901, 902 causes the white ink in the interior of the first supply flow paths 711, 712 to flow into the circulation flow paths 731, 732, respectively, through the connection portions 756A, 757A. The white ink that has flowed into the circulation flow paths 731, 732 then once again flows into the first supply flow paths 711, 712 at the connection portions 754A, 755A. The white ink thus circulates through the first supply flow paths 711, 712 and the circulation flow paths 731, 732. The possibility that the white ink will settle out in the first supply flow paths 711, 712 and the circulation flow paths 731, 732 is thus diminished.

The printer 1 performs a purge by operating the pump 905 to generate negative pressure in the first area 661 and the second area 662 of the cap 67. Next, the purge will be explained. Hereinafter, processing that performs the purge will be called the purge processing. A suction purge is included in the purge. The suction purge is an operation that, by applying negative pressure from outside the head 110, forcibly discharges from the nozzles 113 the ink 91 that contains foreign matter, air bubbles, and the like. By performing the purge, the printer 1 is able to reduce the possibility that a failure to discharge the ink 91 will occur in the head 110. Note that the printer 1 performs the suction purge by opening the waste liquid on-off valves 781, 782 and operating the pump 905 to generate negative pressure in the first area 661 and the second area 662 of the cap 67 in a state in which the cap 67 is in the covering position.

The printer 1 performs a printing operation when the head units 100, 200 are in the printing area 130 (refer to FIG. 2). The white ink contains pigment components that are more prone to sedimentation than are the pigment components of the color inks. The possibility therefore exists that the pigment of the white ink will settle out in the interior of the first flow paths 71A, 71B. The printer 1 provides the circulation flow paths 731 to 734 for the corresponding first supply flow paths 711 to 714 that are connected to the head unit 100. Therefore, the white ink is agitated by being circulated through the first flow paths 71A, 71B. The printer 1 is therefore able to prevent the white ink pigment from settling out in the first flow paths 71A, 71B and can prevent the white ink pigment from concentrating in the first supply flow paths 711 to 714. The printer 1 is therefore able to maintain the printing quality.

Electrical Configuration of the Printer 1

Figure 6:
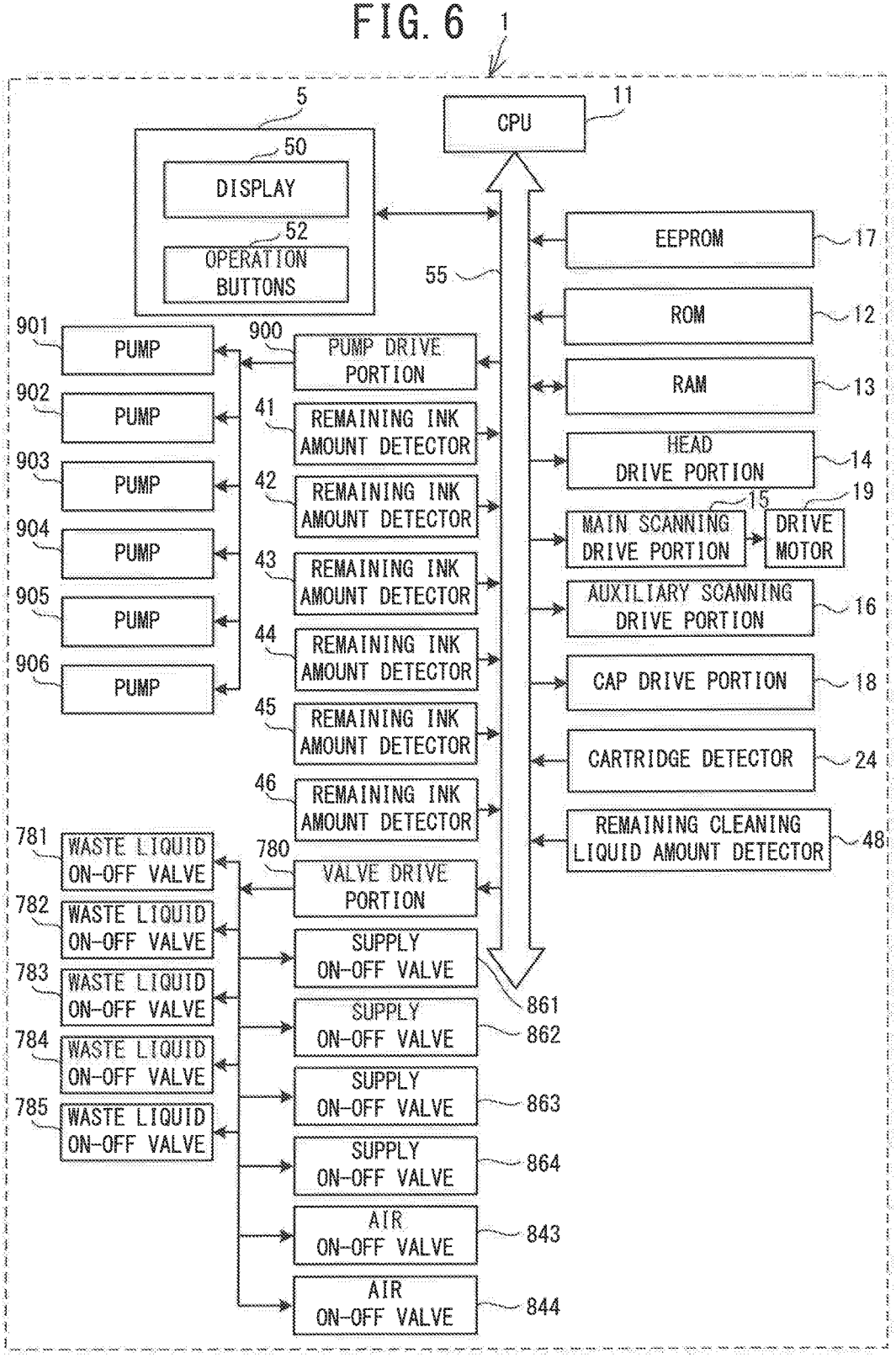
FIG. 6 is a block diagram that shows an electrical configuration of the printer.

As shown in FIG. 6, the printer 1 is provided with a CPU (central processing unit) 11, which controls the printer 1. Through a bus 55, the CPU 11 is electrically connected to an EEPROM (electrically erasable programmable read-only memory) 17, a ROM (read-only memory) 12, a RAM (random access memory) 13, a head drive portion 14, a main scanning direction drive portion 15, an auxiliary scanning direction drive portion 16, a cap drive portion 18, the operation portion 5, a pump drive portion 900, a valve drive portion 780, cartridge detectors 24, remaining ink amount detectors 41, 42, 43, 44, 45, 46, and a remaining cleaning liquid amount detector 48. The remaining ink amount detectors 41 to 46 are provided in the housing 81 of the mounting portion 80, and each one of the remaining ink amount detectors 41 to 46 is configured from two optical detection portions. Each one of the optical detection portions is configured from a light emitting portion that is not shown in the drawings and a light receiving portion that is not shown in the drawings. The cartridges 311, 312, 323, 324, 321, 322 are each provided with a first display portion (not shown in the drawings) and a second display portion (not shown in the drawings), which are made from plates that move up and down in accordance with the remaining amount of the ink. The remaining amount of the ink is displayed at four levels by the up-down movements of the first display portion and the second display portion. When the cartridges 311, 312, and 321 to 324 are mounted in the mounting portion 80, the light from the light emitting portions in the two optical detection portions in each one of the remaining ink amount detectors 41 to 46 is blocked or not blocked by the up-down movements of the first display portion and the second display portion in the corresponding cartridges 311, 312, and 321 to 324. When the light receiving portion of any one of the optical detection portions detects light, the optical detection portion outputs a "1". When the light receiving portion of any one of the optical detection portions does not detect light, the optical detection portion outputs a "0". As will be explained later, each one of the remaining ink amount detectors 41 to 46 is able to transmit a first signal to the CPU 11. The first signal is a combination of the 1's and 0's that are the output values from the optical detection portions. The CPU 11 of the printer 1 detects the amounts of the remaining ink by detecting the combinations of 1's and 0's in the first signals. Note that the remaining ink amount detectors 41 to 46 are not limited to the structure that is described above, and any structure that is capable of detecting the amounts of the remaining inks in the cartridges 311, 312, and 321 to 324 may be used. For example, holes may be provided in the bottoms of the cartridges 311, 312, and 321 to 324, and the amounts of the remaining inks may be detected by optical sensors. The CPU 11 may also count the dots of ink that are discharged from the nozzles 113, calculate the amounts of the inks that have been used, determine the amounts of the remaining inks, and store the remaining amounts in the EEPROM 17. The remaining cleaning liquid amount detector 48 is provided in a cleaning liquid tank 705. The remaining cleaning liquid amount detector 48 transmits a second signal, which will be described later, to the CPU 11 through the bus 55.

The ROM 12 stores a control program by which the CPU 11 controls the printer 1, as well as initial values and the like. The RAM 13 temporarily stores various types of data that are used by the control program. The EEPROM 17 stores various types of flags. The head drive portion 14 is electrically connected to the heads 110, which discharge the inks, and causes the inks to be discharged from the nozzles 113 by operating piezoelectric elements that are located in individual discharge channels of the heads 110 (refer to FIG. 3).

The main scanning drive portion 15 includes the drive motor 19 (refer to FIG. 1), and it moves the carriage 20 in the left-right direction (the main scanning direction). The auxiliary scanning drive portion 16 includes a motor that is not shown in the drawings, as well as gears and the like, and by operating the platen drive mechanism 6 (refer to FIG. 1), it moves the platen, which is not shown in the drawings, in the front-rear direction (the auxiliary scanning direction).

The cap drive portion 18 includes a drive motor (not shown in the drawings), as well as gears and the like, and it moves the cap 67 up and down. The operation of the cap drive portion 18 moves the cap 67 of the maintenance portion 141 and the cap support portion 69 of the maintenance portion 142 up and down simultaneously. The operation portion 5 is provided with the display 50 and the operation buttons 52. The outputs from the operation buttons 52 are input to the CPU 11.

The cartridge detectors 24 are located in the lower mounting portions 811, 812, and they detect that the mounting of the cartridges 311, 312, and 321 to 324. An optical sensor is an example of the cartridge detector 24. The cartridge detectors 24 output ON signals when the cartridges 311, 312, and 321 to 324 are mounted in the corresponding lower mounting portions 811, 812, for example. The ON signals are not output when the cartridges 311, 312, and 321 to 324 have not been mounted. The pump drive portion 900 controls the pumps 901 to 906. The valve drive portion 780 controls the waste liquid on-off valves 781 to 785, supply on-off valves 861 to 864, and air on-off valves 843, 844, all of which are electromagnetic valves.

Structure of Maintenance Flow Path Systems 800, 804

Figure 8:
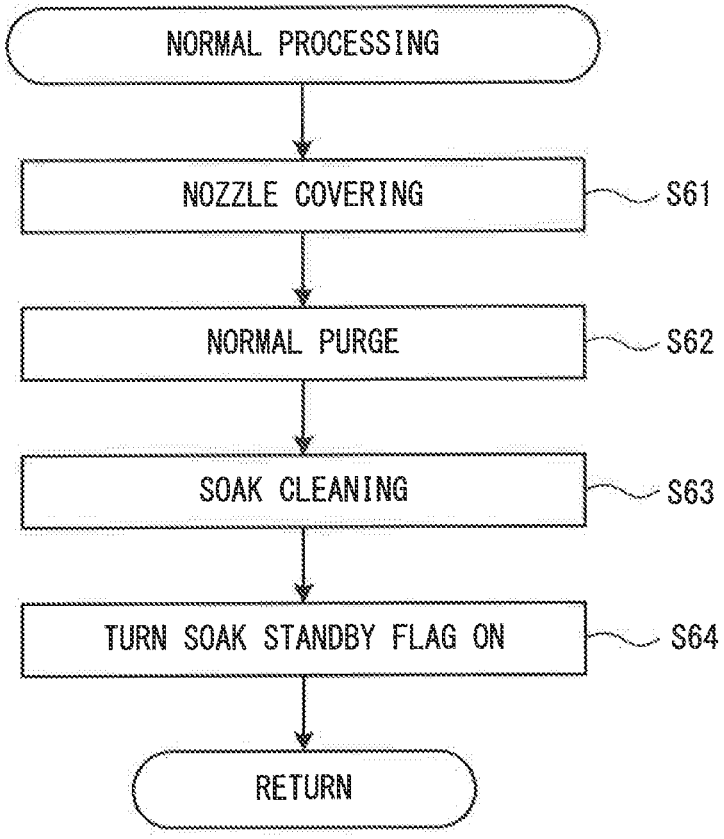
FIG. 8 is a flowchart of normal processing.
Figure 9:
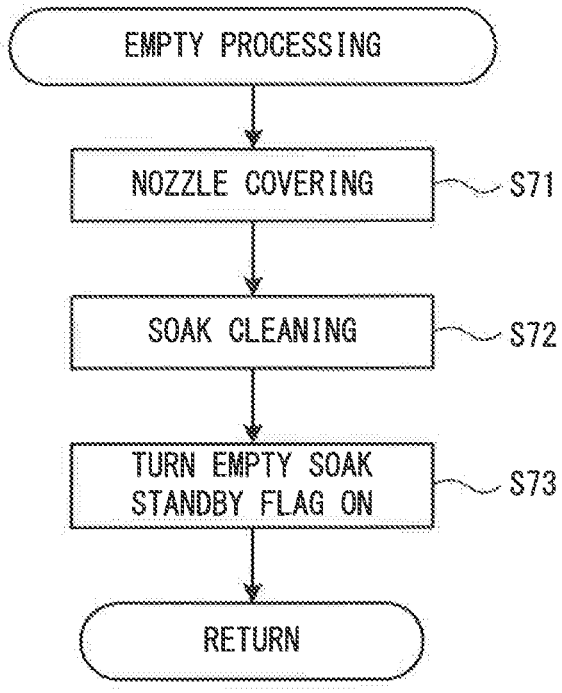
FIG. 9 is a flowchart of empty processing.

As shown in FIG. 4, the printer 1 is provided with a maintenance flow path system 800 for the head unit 100. To make the drawing easier to understand, the maintenance flow path system 800 and the head 110 are shown schematically in FIG. 4. The maintenance flow path system 800 is a mechanism through which the inks, a cleaning liquid 92, and air flow when soak cleaning (refer to FIG. 8, Step S63; FIG. 9, Step S72), which will be described later, is performed. The maintenance flow path system 800 is provided with the cleaning liquid tank 705, supply flow paths 815, 816, the supply on-off valves 861, 862, a gas flow path 873, a connecting path 874, the air on-off valve 843, the waste liquid flow paths 771, 772, 774, the waste liquid on-off valves 781, 782, the pump 905, and the waste liquid tank 706.

The cleaning liquid tank 705 is a container that stores the cleaning liquid 92. The supply flow path 815 is a flow path that is connected to the cleaning liquid tank 705 and to the first area 661 in the cap 67. The operating of the pump 905 makes it possible for the supply flow path 815 to take the cleaning liquid 92 that is stored in the cleaning liquid tank 705 and supply it to the first area 661 in the cap 67. The supply flow path 816 is a flow path that is connected to the cleaning liquid tank 705 and to the second area 662 in the cap 67. In the same manner as the supply flow path 815, the supply flow path 816 is able to supply the cleaning liquid 92 to the second area 662 in the cap 67.

The supply on-off valves 861, 862 are electromagnetic valves that are respectively provided in the supply flow paths 815, 816 and that open and close the supply flow paths 815, 816. The gas flow path 873 is connected to the supply flow path 815 at a convergence portion 851 that is located between the supply on-off valve 861 and the cleaning liquid tank 705. Therefore, the gas flow path 873 is connected to the first area 661 of the cap 67 through the supply flow path 815. The opposite end of the gas flow path 873 from the convergence portion 851 is open to the atmosphere. Therefore, the gas flow path 873 is a flow path through which air passes. The air on-off valve 843 is an electromagnetic valve that is provided in the gas flow path 873, and it opens and closes the gas flow path 873. The gas flow path 873 is also connected to the supply flow path 816 by the connecting path 874. One end of the connecting path 874 is connected to a convergence portion 853, which is provided in the gas flow path 873 between the convergence portion 851 and the air on-off valve 843. The other end of the connecting path 874 is connected to the supply flow path 816 at a convergence portion 852, which is provided in the supply flow path 816 between the supply on-off valve 862 and the cleaning liquid tank 705. Therefore, the gas flow path 873 is connected to the second area 662 of the cap 67 through the connecting path 874 and the supply flow path 816.

Note that the gas flow path 873 may also be connected directly to the cap 67, without being connected to the supply flow paths 815, 816. In that case, the single gas flow path 873 may be divided into two branches, with one branch being connected to the first area 661 and the other branch being connected to the second area 662. The gas flow path 873 may also be provided in the form of two gas flow paths, with one of the gas flow paths 873 being connected to the first area 661 and the other of the gas flow paths 873 being connected to the second area 662. The convergence portions 852, 853 may also be located in the supply flow paths 816, 815, respectively, between the cap 67 and the supply on-off valves 862, 861. In that case, the gas flow path 873, which is connected to the convergence portions 852, 853, may be provided as a single gas flow path, and it may also be provided in the form of two gas flow paths.

The waste liquid flow path 771 is connected to the first area 661 of the cap 67. The waste liquid flow path 772 is connected to the first area 662 of the cap 67. The waste liquid flow paths 771, 772 converge at the convergence portion 791 to form the single waste liquid flow path 774. The waste liquid flow path 774 is connected to the waste liquid tank 706. The waste liquid tank 706 is a container that stores the inks and the cleaning liquid 92 that have been drained out of the cap 67. The pump 905 is provided in the waste liquid flow path 774. The operation of the pump 905 enables the waste liquid flow paths 771, 772, 774 to drain the inks and the cleaning liquid 92 out of the cap 67. The waste liquid on-off valves 781, 782 are electromagnetic valves that are respectively provided in the waste liquid flow paths 771, 772 and that respectively open and close the waste liquid flow paths 771, 772.

The printer 1 is provided with a maintenance flow path system 804 for the head unit 200. In FIG. 4, to make the drawing easier to understand, the maintenance flow path system 804 and the head 110 are shown schematically. The maintenance flow path system 804 is a mechanism through which the inks, the cleaning liquid 92, and air flow when the soak cleaning (refer to FIG. 8, Step S63; FIG. 9, Step S72), which will be described later, is performed. The maintenance flow path system 804 is provided with the cleaning liquid tank 705, supply flow paths 817, 818, the supply on-off valves 863, 864, a gas flow path 875, a connecting path 876, the air on-off valve 844, the waste liquid flow paths 775, 776, 778, the waste liquid on-off valves 784, 785, the pump 906, and the waste liquid tank 706. The cleaning liquid tank 705 and the waste liquid tank 706 may be the same tanks that are used with the maintenance flow path system 800, and they may also be a separate set of tanks.

The cleaning liquid tank 705 is a container that stores the cleaning liquid 92. The supply flow path 817 is a flow path that is connected to the cleaning liquid tank 705 and to the first area 661 in the cap 67. The operating of the pump 906 makes it possible for the supply flow path 817 to take the cleaning liquid 92 that is stored in the cleaning liquid tank 705 and supply it to the first area 661 in the cap 67. The supply flow path 818 is a flow path that is connected to the cleaning liquid tank 705 and to the second area 662 in the cap 67. In the same manner as the supply flow path 817, the supply flow path 818 is able to supply the cleaning liquid 92 to the second area 662 in the cap 67.

The supply on-off valves 863, 864 are electromagnetic valves that are respectively provided in the supply flow paths 817, 818 and that open and close the supply flow paths 817, 818. The gas flow path 875 is connected to the supply flow path 817 at a convergence portion 854 that is located between the supply on-off valve 863 and the cleaning liquid tank 705. Therefore, the gas flow path 875 is connected to the first area 661 of the cap 67 through the supply flow path 817. The opposite end of the gas flow path 875 from the convergence portion 854 is open to the atmosphere. Therefore, the gas flow path 875 is a flow path through which air passes. The air on-off valve 844 is an electromagnetic valve that is provided in the gas flow path 875, and it opens and closes the gas flow path 875. The gas flow path 875 is also connected to the supply flow path 818 by the connecting path 876. One end of the connecting path 876 is connected to a convergence portion 855, which is between the convergence portion 854 and the air on-off valve 844. The other end of the connecting path 876 is connected to the supply flow path 818 at a convergence portion 856, which is located between the supply on-off valve 864 and the cleaning liquid tank 705. Therefore, the gas flow path 875 is connected to the second area 662 of the cap 67 through the connecting path 876 and the supply flow path 818.

Note that the gas flow path 875 may also be connected directly to the cap 67, without being connected to the supply flow paths 817, 818. In that case, the single gas flow path 875 may be divided into two branches, with one branch being connected to the first area 661 and the other branch being connected to the second area 662. The gas flow path 875 may also be provided in the form of two gas flow paths, with one of the gas flow paths 875 being connected to the first area 661 and the other of the gas flow paths 875 being connected to the second area 662. The convergence portions 856, 855 may also be located in the supply flow paths 818, 817, respectively, between the cap 67 and the supply on-off valves 864, 863. In that case, the gas flow path 875, which is connected to the convergence portions 856, 855, may be provided as a single gas flow path, and it may also be provided in the form of two gas flow paths.

The waste liquid flow path 775 is connected to the first area 661 of the cap 67. The waste liquid flow path 776 is connected to the first area 662 of the cap 67. The waste liquid flow paths 775, 776 converge at a convergence portion 792 to form the single waste liquid flow path 778. The waste liquid flow path 778 is connected to the waste liquid tank 706. The pump 906 is provided in the waste liquid flow path 778. The operation of the pump 906 enables the waste liquid flow paths 775, 776, 778 to drain the inks and the cleaning liquid 92 out of the cap 67. The waste liquid on-off valves 784, 785 are electromagnetic valves that are respectively provided in the waste liquid flow paths 775, 776 and that respectively open and close the waste liquid flow paths 775, 776.

Normal Standby Time Maintenance Control

Figure 7:
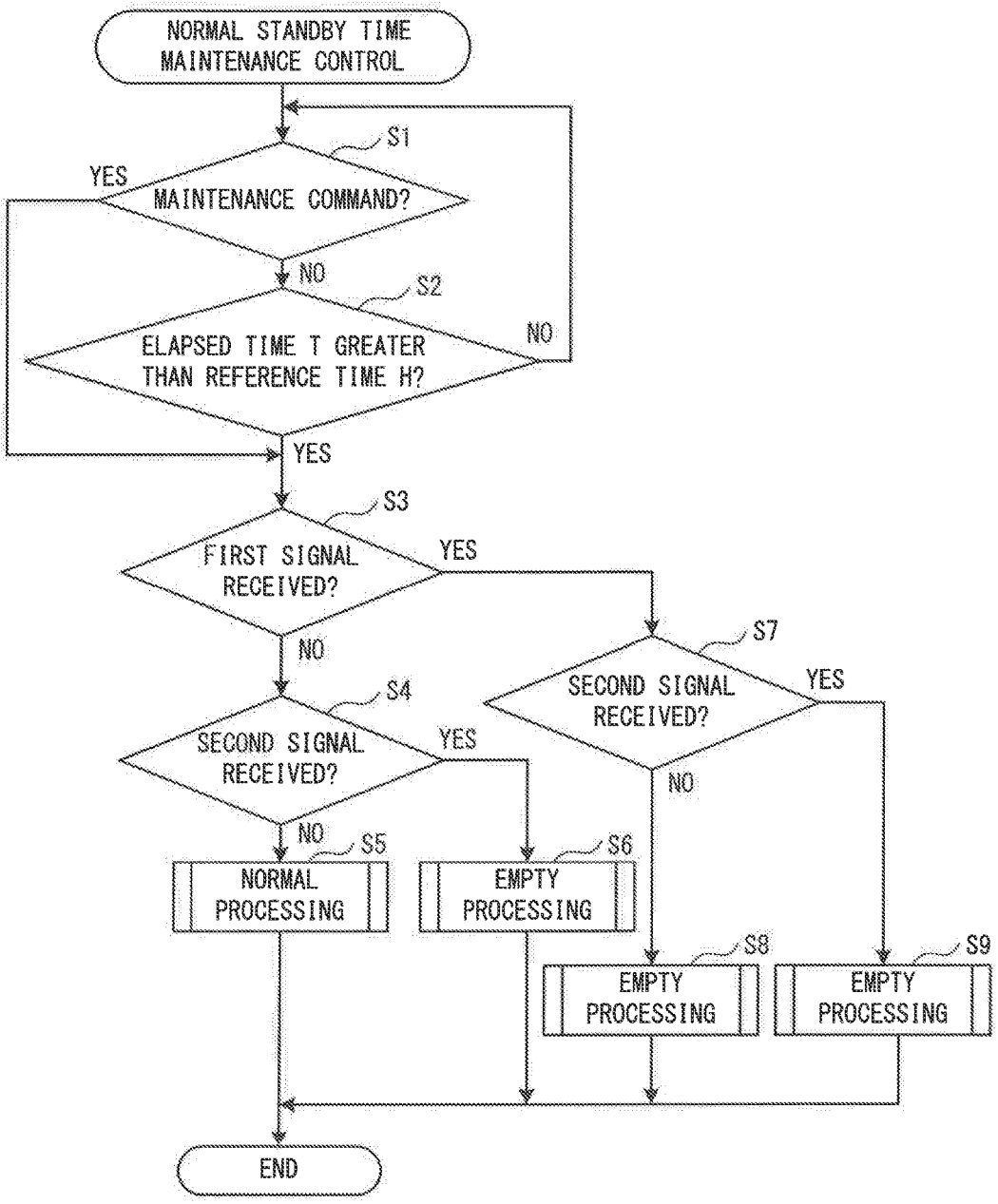
FIG. 7 is a flowchart of normal standby time maintenance control.

Normal standby time maintenance control by the CPU 11 of the printer 1 will be explained with reference to FIGS. 7 to 9. Operating based on the control program that is stored in the ROM 12, the CPU 11 controls the printer 1 to perform the normal standby time maintenance control that is shown in FIG. 7. First, the CPU 11 determines whether a maintenance command has been received (Step S1). The maintenance command is transmitted to the CPU 11 by pressing the operation buttons 52 of the operation portion 5, for example. When the CPU 11 does not determine that the maintenance command has been received (NO at Step S1), the CPU 11 determines whether an elapsed time T is greater than a reference time H (Step S2). The elapsed time T is a counter that counts the time since the printing operation was completed. The elapsed time T is stored in the RAM 13. Each time the printing operation is completed, the CPU 11 resets the elapsed time T to zero, and the elapsed time T starts counting the time. The reference time H is eight hours, for example. When eight hours have elapsed since the last time printing was performed, the viscosity of the inks inside the nozzles 113 increases markedly, so in the processing at Step S2, the CPU 11 determines whether the elapsed time T is greater than eight hours. If the CPU 11 determines that the elapsed time T is greater than the reference time H (YES at Step S2), the CPU 11 determines whether the first signal has been received from any of the remaining ink amount detectors 41 to 46 (Step S3). In a case where the CPU 11 has determined that the maintenance command has been received (YES at Step S1), the CPU 11, without performing the determination at Step S2, determines whether the first signal has been received from any of the remaining ink amount detectors 41 to 46 (Step S3). Hereinafter, the determination processing at Step S3 will be called the first determination processing.

When the amount of the ink remaining in any one of the cartridges 311, 312, and 321 to 324 becomes not greater than a first prescribed amount, the corresponding one of the remaining ink amount detectors 41 to 46 outputs the first signal. Alternatively, each one of the remaining ink amount detectors 41 to 46 may constantly transmit to the CPU 11 a remaining amount signal that indicates the amount of the ink remaining in the corresponding one of the cartridges 311, 312, and 321 to 324. The CPU 11 may then determine, based on the remaining amount signal, whether the amount of the ink remaining in the corresponding one of the cartridges 311, 312, and 321 to 324 has become not greater than the first prescribed amount. In the explanation that follows, the remaining ink amount detector 41, which detects the amount of the white ink 91 remaining in the cartridge 311, will be used as an example. The other remaining ink amount detectors 42 to 46, which detect the amounts of the inks remaining in the cartridges 312 and 321 to 324, may also perform the same sort of processing as that hereinafter described. The first prescribed amount may be the amount of the ink that is required for one round of the purge processing, for example, and may be set to 1.5 cubic centimeters, for example. The first prescribed amount may also be the amount of the ink for which the CPU 11 displays on the display 50 a warning that indicates that the ink has reached an empty state, for example, and may be set to 20 cubic centimeters, for example. The first prescribed amount may also be an amount of the ink, such as 100 cubic centimeters, for example, at which the ink is approaching the empty state or is in a near-empty state. The first prescribed amount may also be the amount of the ink that is required for a specified number of rounds of the purge processing to be performed, such as twenty rounds, for example.

In a case where the CPU 11 does not determine that the first signal has been received from the remaining ink amount detector 41 (NO at Step S3), the CPU 11 determines whether the second signal has been received from the remaining cleaning liquid amount detector 48 (Step S4). The second signal is a signal that the remaining cleaning liquid amount detector 48 outputs, and it indicates that the amount of the remaining cleaning liquid 92 is less than a specified amount and is not less than a second prescribed amount that is necessary in order to perform one round of processing for the soak cleaning of the nozzle face 111. The soak cleaning is processing that puts the cleaning liquid 92 that has filled the cap 67 into a state in which it soaks the nozzle face 111. The specified amount is set in advance to be greater than the second prescribed amount that is necessary in order to perform at least one round of the soak cleaning of the nozzle face 111. For example, the specified amount may be an amount that enables two, three, or four rounds of the soak cleaning processing of the nozzle face 111 to be performed. Note that the remaining cleaning liquid amount detector 48 may be an electrode type sensor, for example, with one electrode at the position of the second prescribed amount in the cleaning liquid tank 705 and another electrode at the position of the specified amount. When the remaining amount of the cleaning liquid 92 becomes less than the specified amount and not less than the second prescribed amount that is necessary in order to perform one round of the soak cleaning processing, which will be described later, the remaining cleaning liquid amount detector 48 transmits the second signal to the CPU 11 through the bus 55. The remaining cleaning liquid amount detector 48 may be an electrostatic capacitance type sensor that constantly transmits to the CPU 11 a signal that indicates the remaining amount of the cleaning liquid 92. The CPU 11 may determine whether the remaining amount of the cleaning liquid 92 is less than the specified amount and not less than the second prescribed amount that is necessary in order to perform one round of the soak cleaning processing, which will be described later. The second prescribed amount that is necessary in order to perform one round of the processing for the soak cleaning may be 6.6 cubic centimeters, for example. The specified amount may be, for example, an amount at which the CPU 11 displays on the display 50 a warning about the remaining amount of the cleaning liquid 92. For example, the specified amount may be an amount that is greater than the amount that is necessary in order to perform one round of the soak cleaning processing, and approximately one-third or the like of the amount of the cleaning liquid 92 when the cleaning liquid tank 705 is full. Hereinafter, the determination processing at Step S4 will be called the second determination processing.

Normal Processing

In a case where the CPU 11 does not determine that the second signal has been received from the remaining cleaning liquid amount detector 48 (NO at Step S4), the CPU 11 performs normal processing (Step S5). The CPU 11 performs the normal processing (Step S5) according to the normal processing subroutine that is shown in FIG. 8. First, the CPU 11 performs nozzle covering (Step S61). The CPU 11 moves the cap 67 upward by operating the cap drive motor (not shown in the drawings), as well as gears and the like, of the cap drive portion 18. The cap 67 seals the nozzle face 111, putting the nozzles 113 into a covered state.

Normal Purge

Next, the CPU 11 performs a normal purge (Step S62). The CPU 11 performs the normal purge in a state in which the cap 67 is in the covering position. The CPU 11 opens the waste liquid on-off valves 781, 782 and operates the pump 905, thus generating negative pressure in the first area 661 and the second area 662 of the cap 67 and drawing the white ink out of the nozzles 113. The time required for the normal purge may be one-and-a-half minutes, for example. The negative pressure for the normal purge is in the range from −60 to −80 kPa, for example.

Soak Cleaning

Figure 10:
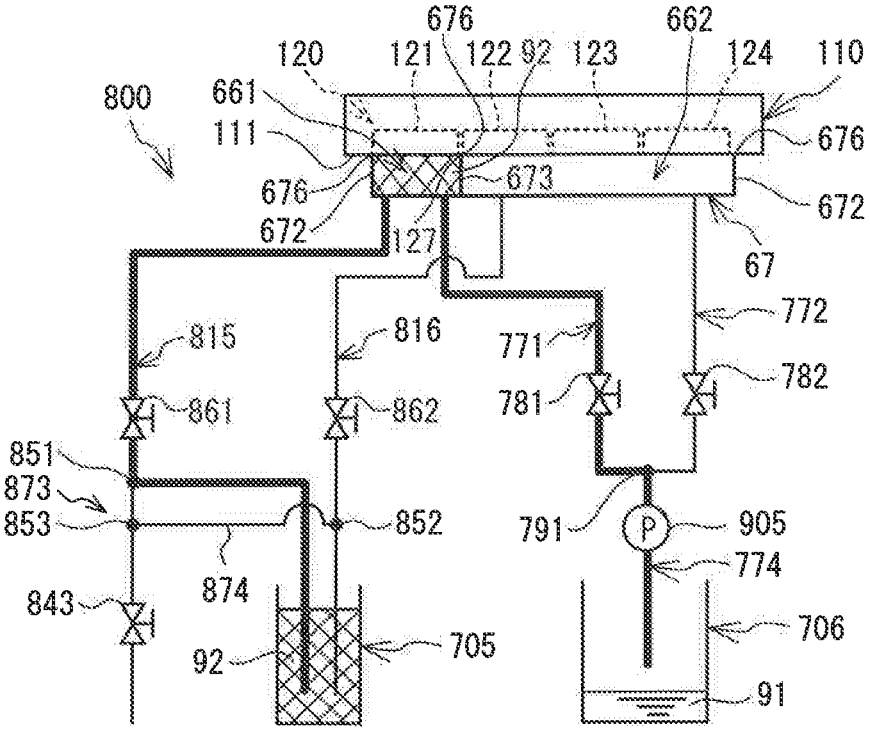
FIG. 10 is a schematic diagram of a maintenance flow path system, showing a state in which a cleaning liquid that has been injected into a first area is soaking a nozzle face.

Next, the CPU 11 performs the soak cleaning (Step S63), in which the supply flow path 815, as shown in FIG. 10, is used to fill the first area 661 with the cleaning liquid 92, which puts the cleaning liquid 92 in contact with the nozzle face 111. While the CPU 11 is performing the soak cleaning, unless otherwise specified for the maintenance flow path system 804 (refer to FIGS. 4 and 5), it is preferable for the waste liquid on-off valve 785 and the supply on-off valve 864, which is the electromagnetic valve that is located in the supply flow path 818, to be closed. The air on-off valve 844 may be closed, and it may also be open. Hereinafter, in the explanation of the soak cleaning, an explanation of the control of the electromagnetic valves that are located in the maintenance flow path system 804 will be omitted.

The CPU 11 supplies the cleaning liquid 92 from the cleaning liquid tank 705 to the first area 661 of the cap 67 through the supply flow path 815. The CPU 11 first performs valve operations, for example. For example, the CPU 11 closes the air on-off valve 843 and opens the supply on-off valve 861. At this time, the waste liquid on-off valve 781 is open. Next, the CPU 11 operates the pump 905 for a specified length of time at a specified revolution speed. When the pump 905 is operated, the cleaning liquid 92 is supplied from the cleaning liquid tank 705 to the first area 661 of the cap 67 through the supply flow path 815, and the cleaning liquid 92 soaks the nozzle face 111. Next, the CPU 11 stops the pump 905, closes the supply on-off valve 861, and closes the waste liquid on-off valve 781. The soak cleaning prevents the nozzles 113 from drying out. Note that the CPU 11 performs the same sort of processing for the second area 662 as well. Accordingly, the cleaning liquid 92 is supplied from the cleaning liquid tank 705 to the second area 662 of the cap 67 through the supply flow path 816, and the cleaning liquid 92 soaks the nozzle face 111. The CPU 11 stops the pump 905, closes the supply on-off valve 861, and closes the waste liquid on-off valve 781, so it is possible to supply the cleaning liquid 92 to the cap 67 and to keep the cleaning liquid 92 inside the cap 67 in a state in which the cleaning liquid 92 soaks the nozzle face 111. Next, the CPU 11 stores a soak standby flag in the EEPROM 17 (Step S64). The soak standby flag is a flag that indicates a soak state and is a flag that indicates that the printing operation can be performed. In the processing at Step S64, the CPU 11 stores in the EEPROM 17 the time when the soak cleaning (Step S63) was performed. In a case where the CPU 11 has determined, in the second determination processing (Step S4), that the second signal has been received from the remaining cleaning liquid amount detector 48 (YES at Step S4), the CPU 11 performs empty processing (Step S6).

Empty Processing

The CPU 11 performs the empty processing (Step S6) according to the empty processing subroutine that is shown in FIG. 9. In the empty processing, the CPU 11 first performs the nozzle covering (Step S71). The processing at Step S71 is the same as the processing at Step S61 in the normal processing that is shown in FIG. 8. Next, the CPU 11 performs the soak cleaning (Step S72) without performing a purge. The processing at Step S72 is the same as the processing at Step S63 in the normal processing that is shown in FIG. 8.

The soak cleaning prevents the nozzles 113 in the nozzle face 111 from drying out. Therefore, it is possible to supply the cleaning liquid 92 to the cap 67 and to keep the cleaning liquid 92 inside the cap 67 in a state in which the cleaning liquid 92 soaks the nozzle face 111. Next, the CPU 11 stores an empty soak standby flag in the EEPROM 17 (Step S73). The empty soak standby flag is a flag that indicates the soak state and also prohibits the performing of the printing operation. In the processing at Step S73, the CPU 11 stores in the EEPROM 17 the time when the soak cleaning (Step S72) was performed. If the empty soak standby flag is stored in the EEPROM 17 when a command to perform the printing operation is received, the CPU 11 does not perform the printing operation. Note that in the empty processing (Step S6), the CPU 11 may also display on the display 50 a display that urges that the cleaning liquid 92 be refilled.

In a case where the CPU 11 has determined, in the determination at Step S3, that the first signal has been received from any of the remaining ink amount detectors 41 to 46 (YES at Step S3), the CPU 11 determines whether the second signal has been received from the remaining cleaning liquid amount detector 48 (Step S7). The determination processing at Step S7 is the same as the determination processing at Step S4. Hereinafter, the determination processing at Step S7 will also be called the second determination processing. In a case where the CPU 11 does not determine that the second signal has been received from the remaining cleaning liquid amount detector 48 (NO at Step S7), the CPU 11 performs the empty processing (Step S8). The CPU 11 performs the empty processing (Step S8) according to the empty processing subroutine that is shown in FIG. 9. Therefore, the empty processing (Step S8) is the same as the processing at Step S6. Note that in the empty processing (Step S8), the CPU 11 may also display on the display 50 a display that urges that the ink be refilled.

In a case where the CPU 11 has determined that the second signal has been received from the remaining cleaning liquid amount detector 48 (YES at Step S7), the CPU 11 performs the empty processing (Step S9). The CPU 11 performs the empty processing (Step S9) according to the empty processing subroutine that is shown in FIG. 9. Therefore, the empty processing (Step S9) is the same as the processing at Steps S6 and S8. In the empty processing (Step S9), the CPU 11 may also display on the display 50 a display that urges that both the ink and the cleaning liquid 92 be refilled. In a case where the processing at any one of the Steps S5, S6, S8, and S9 has been completed, the CPU 11 terminates the normal standby time maintenance control.

Recovery Control

Recovery control that is performed by the CPU 11 of the printer 1 after soak standby will be explained with reference to FIGS. 11 and 12. When the power supply to the printer 1 is turned on, the CPU 11 first determines whether a specified length of time has elapsed since the previous round of the normal processing or the empty processing (Step S21). The specified length of time is a time that is based on an expiry time for the cleaning liquid 92, such as sixteen weeks, for example. For example, the CPU 11 determines whether sixteen weeks have elapsed since the time, as stored in the EEPROM 17, when the normal processing (Step S5) was completed, or since the time, as stored in the EEPROM 17, when the empty processing (Steps S6, S8, S9) was completed (Step S21).

In a case where the CPU 11 has determined that the specified length of time has elapsed since the normal processing (Step S5) was completed or the empty processing (Steps S6, S8, S9) was completed (YES at Step S21), the CPU 11 displays on the display 50 a recommendation display that recommends a user to replace a filling liquid (Step S22). For example, the CPU 11 displays "Please mount a cartridge of the filling liquid" on the display 50 (Step S22). Next, the CPU 11 determines whether the filling liquid has been supplied (Step S35). For example, the CPU 11 determines whether the cartridge 311 has been replaced with the cartridge of the filling liquid. The cartridge of the filling liquid may have projections and indentations that indicate that it is the cartridge of the filling liquid, for example, such that the cartridge detector 24 can detect that it is the cartridge of the filling liquid. In a case where the CPU 11 has received a detection signal of the cartridge of the filling liquid from the cartridge detector 24, the CPU 11 determines that the filling liquid has been supplied (YES at Step S35). In a case where the display at Step S22 indicates that one of the cartridge detectors 24 has detected the mounting of any one of the cartridges 311, 312, and 321 to 324, the CPU 11 may regard that as indicating that the cartridge of the filling liquid has been mounted and determine that the filling liquid has been supplied (YES at Step S35).

In a case where the CPU 11 has determined that the filling liquid has been supplied (YES at Step S35), the CPU 11 performs replacement processing (Step S36). In the replacement processing (Step S36), the CPU 11 operates the pumps 901, 902 to resupply the filling liquid to the supply flow paths 711, 712, the circulation flow paths 731, 732, and the head 110. The CPU 11 then terminates the processing. In a case where the CPU 11 does not determine that the filling liquid has been supplied (NO at Step S35), the CPU 11 returns the processing to Step S22.

In a case where the CPU 11 does not determine that the specified length of time has elapsed since the normal processing (Step S5) was completed or the empty processing (Steps S6, S8, S9) was completed (NO at Step S21), the CPU 11 determines whether a circulation command to perform the circulation processing has been input from the operation buttons 52 of the operation portion 5 (Step S23). In a case where the CPU 11 has determined that the circulation command has been input (YES at Step S23), the CPU 11 performs the circulation processing (Step S24).

Circulation Processing

The CPU 11 performs the ink circulation processing (Step S24) in accordance with a circulation processing time and a pump revolution speed that are stored in the ROM 12. The CPU 11 performs the circulation processing by using the pump drive portion 900 to operate the pumps 901 to 904 such that negative pressure is generated in the circulation flow paths 731 to 734. When the printer 1 performs the circulation processing, the white ink circulates within the first flow paths 71A, 71B as indicated by arrows 90 in FIGS. 4 and 5. The white ink is thus agitated in the first flow paths 71A, 71B. The printer 1 performs the circulation processing while the printing operation is not being performed and the heads 110 of the head units 100, 200 are not discharging the inks. After the circulation processing (Step S24), the CPU 11 returns the processing to Step S21.

In a case where the CPU 11 does not determine that the circulation command has been input (NO at Step S23), the CPU 11 determines whether a specified length of time has elapsed since the previous round of recovery processing (Step S25). The recovery processing includes empty recovery processing (Step S40), which will be described later, and normal recovery processing (Step S41), which will also be described later. As time passes, the extent of the sedimentation of the pigment components in the white ink increases. At Step S25, the CPU 11 makes its determination based on a specified length of time during which the extent of the sedimentation increases and the effect on the discharging from the nozzles 113 becomes greater. The specified length of time may be eighteen hours, for example. In a case where the CPU 11 does not determine that the specified length of time has elapsed since the previous round of the recovery processing (NO at Step S25), the CPU 11 returns the processing to Step S21.

In a case where the CPU 11 has determined that the specified length of time has elapsed since the previous round of the recovery processing (YES at Step S25), the CPU 11 displays on the display 50 a cartridge agitation warning that prompts the user to agitate the white ink cartridges (Step S26). For example, the CPU 11 displays "Please remove the white ink cartridge, agitate it, and set it back in place" on the display 50.

Next, the CPU 11 determines whether the white ink cartridge 311 has been removed from the mounting portion 80 and reset (Step S27). In a case where the user has removed the cartridge 311 from the mounting portion 80, for example, the signal that is input to the CPU 11 from the cartridge detector 24 changes from a state that indicates detection of the cartridge 311 to a state that does not indicate detection of the cartridge 311. Next, in a case where the user has mounted the cartridge 311 in the mounting portion 80, the signal that is input to the CPU 11 from the cartridge detector 24 changes back to the state that indicates detection of the cartridge 311. Therefore, in a case where the signal that is input to the CPU 11 from the cartridge detector 24 has changed from the state that indicates detection of the cartridge 311 to the state that does not indicate detection of the cartridge 311, and has then changed back to the state that indicates detection of the cartridge 311, the CPU 11 determines that the white ink cartridge 311 has been removed from the mounting portion 80 and reset (YES at Step S27). In a case where the CPU 11 has displayed the cartridge agitation warning on the display 50 (Step S26), and thereafter has determined that the white ink cartridge 311 has been removed from the mounting portion 80 and reset (YES at Step S27), the CPU 11 determines that the user has removed the white ink cartridge 311 from the mounting portion 80 and agitated the ink inside the cartridge 311. In a case where the CPU 11 does not determine that the white ink cartridge 311 has been removed from the mounting portion 80 and reset (NO at Step S27), the CPU 11 returns the processing to Step S26. The CPU 11 also makes the same sort of determination for the white ink cartridge 312.

In a case where the CPU 11 has decided YES in the determination at Step S27, the CPU 11 determines whether it has received a recovery processing performance command, which commands the CPU 11 to perform one of the normal recovery processing (Step S41), which will be described later, and the empty recovery processing (Step S40), which will also be described later (Step S28). The CPU 11 determines whether the recovery processing performance command has been input from the operation buttons 52 of the operation portion 5 (Step S28). In a case where the CPU 11 has determined that the recovery processing performance command has been input (YES at Step S28), the CPU 11 determines whether it has received the first signal (Step S29). The determination at Step S29 is the same determination processing as the determination at Step S3 that is shown in FIG. 7. In the determination at Step S29, in a case where the CPU 11 has determined that it has received the first signal from the remaining ink amount detector 41 (YES at Step S29), the CPU 11 determines whether it has received the second signal from the remaining cleaning liquid amount detector 48 (Step S37). The determination at Step S37 is the same determination processing as the determinations at Steps S4 and S7 that are shown in FIG. 7. In the determination at Step S37, in a case where the CPU 11 has determined that it has received the second signal from the remaining cleaning liquid amount detector 48 (YES at Step S37), the CPU 11 stores the empty soak standby flag in the EEPROM 17 (Step S38) and prohibits the printing operation. Note that during the processing at Step S38, the CPU 11 may also display on the display 50 a display that urges that the ink be refilled and that the cleaning liquid 92 be refilled. In the determination at Step S37, in a case where the CPU 11 does not determine that it has received the second signal from the remaining cleaning liquid amount detector 48 (NO at Step S37), the CPU 11 stores the empty soak standby flag in the EEPROM 17 (Step S31) and prohibits the printing operation. Note that during the processing at Step S31, the CPU 11 may also display on the display 50 a display that urges that the ink be refilled.

In a case where the CPU 11 does not determine that it has received the first signal from the remaining ink amount detector 41 (NO at Step S29), the CPU 11 determines whether it has received the second signal from the remaining cleaning liquid amount detector 48 (Step S30). The determination at Step S30 is the same determination processing as the determinations at Steps S4, S7, and S37. In a case where the CPU 11 has determined that it has received the second signal from the remaining cleaning liquid amount detector 48 (YES at Step S30), the CPU 11 stores the empty soak standby flag in the EEPROM 17 (Step S31) and prohibits the printing operation.

Figure 14:
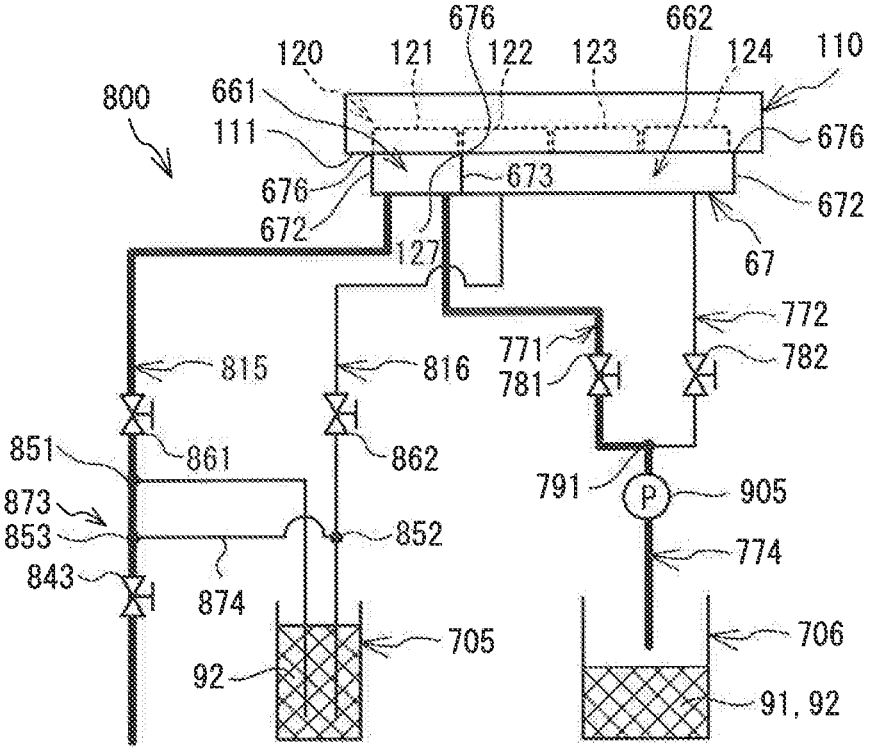
FIG. 14 is a schematic diagram of the maintenance flow path system, showing a state in which the cleaning liquid that has been drained out of the first area.

In a case where the CPU 11 does not determine that it has received the second signal from the remaining cleaning liquid amount detector 48 (NO at Step S30), the CPU 11 performs cleaning liquid discharge processing (Step S32). The cleaning liquid discharge processing is processing that, with the cap 67 in the covering state, in which it covers the nozzle face 111, discharges the cleaning liquid 92 from inside the cap 67. For example, the CPU 11 opens the air on-off valve 843, the waste liquid on-off valve 781, and the supply on-off valve 861. Next, the CPU 11 operates the pump 905. In the processing at Step S32, the cleaning liquid 92 is discharged from the first area 661 through the waste liquid flow paths 771, 774, as shown in FIG. 14. The suction force of the pump 905 causes air to flow into the first area 661 through the gas flow path 873 and causes the cleaning liquid 92 inside the first area 661 to be drained into the waste liquid tank 706 through the waste liquid flow paths 771, 774. Next, the CPU 11 stops the pump 905. The CPU 11 closes the supply on-off valve 861, the waste liquid on-off valve 781, and the air on-off valve 843.

Next, the CPU 11 determines whether the empty soak standby flag is stored in the EEPROM 17 (Step S33). In a case where the CPU 11 does not determine that the empty soak standby flag is stored in the EEPROM 17 (NO at Step S33), the CPU 11 performs the normal recovery processing (Step S41). In a case where the CPU 11 has determined that the empty soak standby flag is stored in the EEPROM 17 (YES at Step S33), the CPU 11 performs the empty recovery processing (Step S40), which will be described later. The normal recovery processing (Step S41) will be explained with reference to the normal recovery processing subroutine that is shown in FIG. 12. In the normal recovery processing, the CPU 11 first performs the nozzle covering (Step S81). The processing at Step S81 is the same as the processing at Step S61 that is shown in FIG. 8.

Strong Purge

Next, the CPU 11 performs a strong purge (Step S82). The strong purge is a purge in which the suction force is greater than in the normal purge (Step S62), or the suction is performed for a longer time. For example, in the strong purge, the CPU 11 may perform the suction (Step S82) for twice as long a period as in the normal purge (Step S62), or with twice as strong a negative pressure. In a case where the negative pressure is −60 to −80 kPa as in the normal purge, the strong purge time may be three minutes, for example.

Flushing

As shown in FIG. 2, the printer 1 is provided with a flushing receiving portion 145 (refer to FIG. 2) in the maintenance portion 141. The flushing receiving portion 145 is a member that sucks in the ink that has been discharged by flushing. Next, the CPU 11 performs the flushing (Step S83). The flushing is an operation that discharges the ink from the nozzles 113 onto the flushing receiving portion 145 (refer to FIG. 2). The performing of the flushing maintains a meniscus in each of the nozzles 113, such that the ink is discharged appropriately from the nozzles 113. In the flushing, for example, the CPU 11 may discharge 350,000 drops of the ink from each one of the nozzles 113 (Step S83).

Next, the CPU 11 performs the normal purge (Step S84). The processing at Step S84 is the same processing as at Step S62 in FIG. 8. Next, the CPU 11 performs the flushing (Step S85). The processing at Step S85 is the same processing as at Step S83. Next, the CPU 11 performs the normal purge (Step S86). The processing at Step S86 is the same processing as at Step S62 in FIG. 8 and at Step S84. Next, the CPU 11 performs the soak cleaning (Step S87). The processing at Step S87 is the same processing as at Step S63 in FIG. 8 and at Step S72 in FIG. 9. Next, the CPU 11 advances the processing to Step S42 in FIG. 11, where it stores a normal standby flag in the EEPROM 17 (Step S42). The normal standby flag is a flag that does not prohibit the printing operation. Therefore, in a case where the normal standby flag is stored in the EEPROM 17, the CPU 11 enables the printing. In a case where the empty soak standby flag is stored in the EEPROM 17, the CPU 11 deletes the empty soak standby flag from the EEPROM 17 (Step S42).

Figure 13:
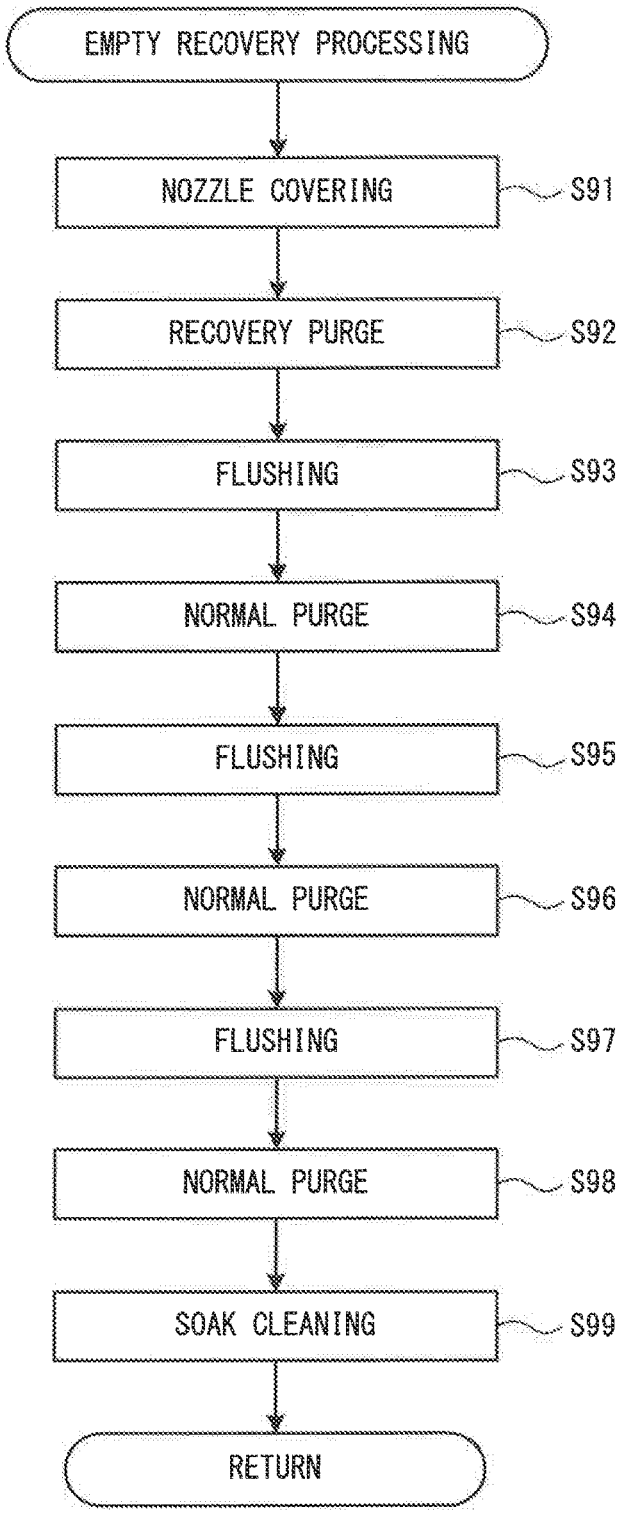
FIG. 13 is a flowchart of empty recovery processing.

In a case where the CPU 11 has determined that the empty soak standby flag is stored in the EEPROM 17 (YES at Step S33), the CPU 11 performs the empty recovery processing (Step S40). The CPU 11 performs the empty recovery processing (Step S40) according to the empty recovery processing subroutine that is shown in FIG. 13. In the empty recovery processing, the CPU 11 first performs the nozzle covering (Step S91). The processing at Step S91 is the same as the processing at Step S61 in the normal processing that is shown in FIG. 8.

Recovery Purge

Next, the CPU 11 performs a recovery purge (Step S92). The recovery purge is a purge in which the suction force is greater than in the normal purge (FIG. 8, Step S62) and the strong purge (FIG. 12, Step S82), or the suction is performed for a longer time. For example, in the recovery purge, the CPU 11 may perform the suction (Step S92) for three times as long a period as in the normal purge (Step S62), or with three times as strong a negative pressure. In a case where the negative pressure is −60 to −80 kPa as in the normal purge, the recovery purge time may be 4.5 minutes, for example.

Next, the CPU 11 performs the flushing (Step S93). The processing at Step S93 is the same processing as at Step S83 in FIG. 12. Next, the CPU 11 performs the normal purge (Step S94). The normal purge at Step S94 is the same processing as at Step S62 in FIG. 8 and Step S84 in FIG. 12. Next, the CPU 11 performs the flushing (Step S95). The processing at Step S95 is the same processing as at Step S83 in FIG. 12. Next, the CPU 11 performs the normal purge (Step S96). The normal purge at Step S96 is the same processing as at Step S62 in FIG. 8 and Step S84 in FIG. 12. Next, the CPU 11 performs the flushing (Step S97). The processing at Step S97 is the same processing as at Steps S83, S85 in FIG. 12 and Steps S93, S95 in FIG. 13. Next, the CPU 11 performs the normal purge (Step S98). The normal purge at Step S98 is the same processing as at Step S62 in FIG. 8, Steps S84, S86 in FIG. 12, and Steps S94, S96 in FIG. 13. Next, the CPU 11 performs the soak cleaning (Step S99). The processing at Step S99 is the same processing as at Step S63 in FIG. 8, Step S72 in FIG. 9, and Step S87 in FIG. 12.

Figure 11:
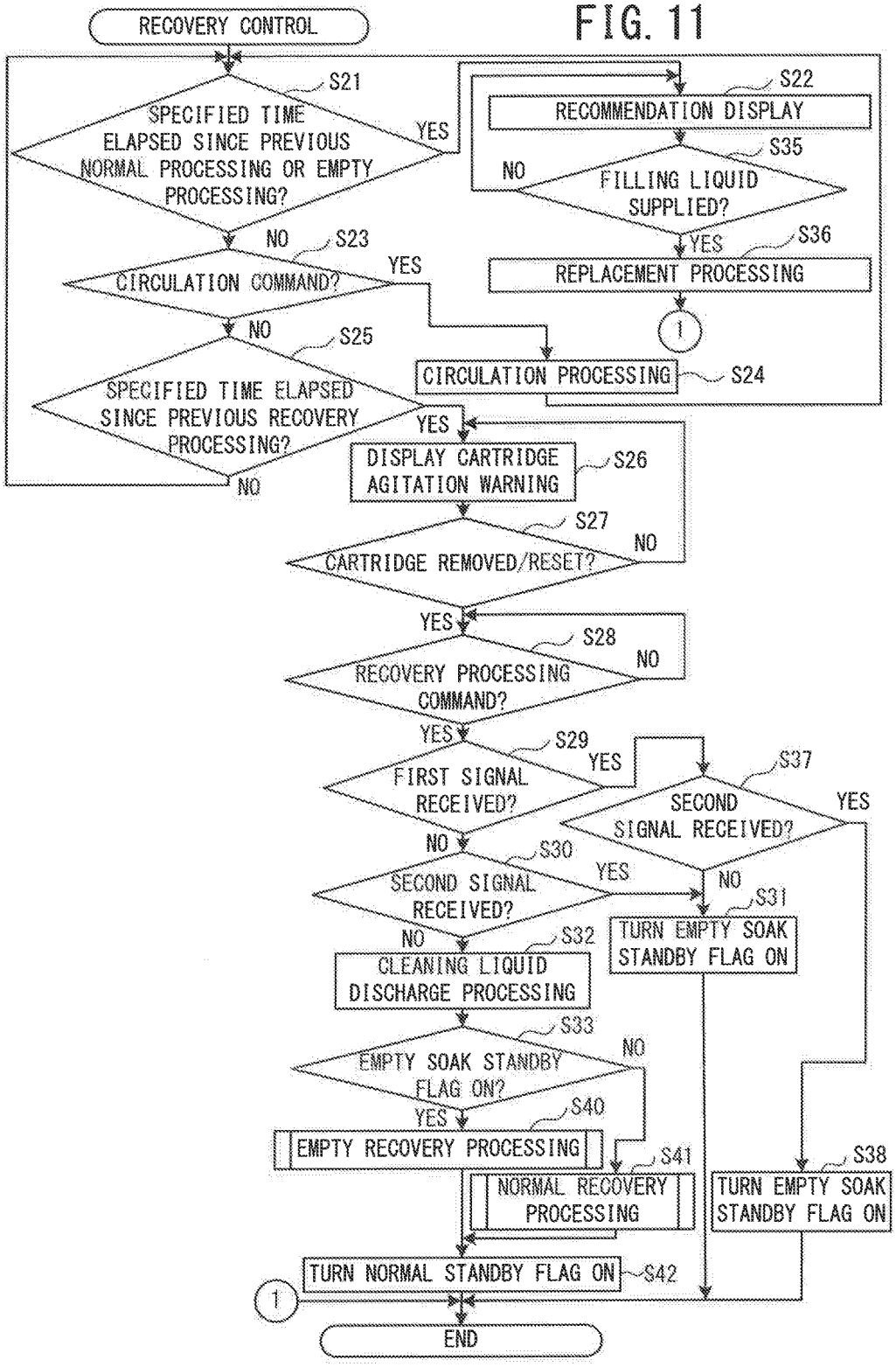
FIG. 11 is a flowchart of recovery control.
Figure 12:
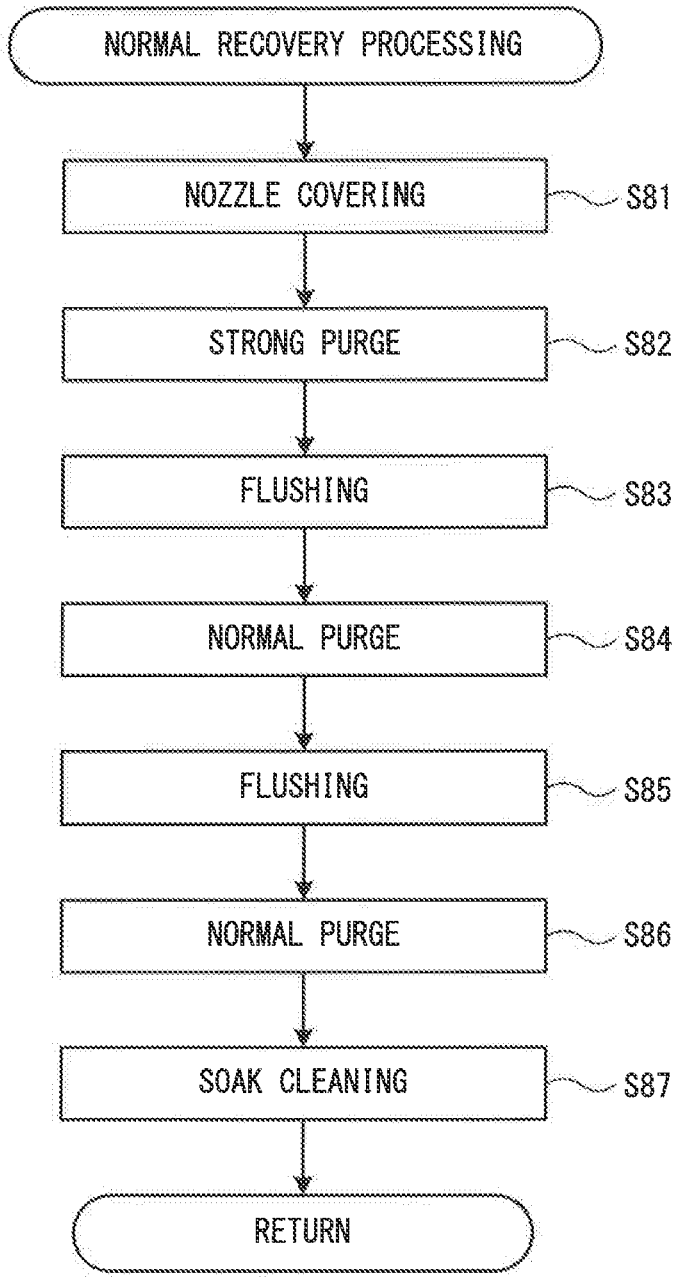
FIG. 12 is a flowchart of normal recovery processing.

Next, the CPU 11 advances the processing to Step S42 in FIG. 11, where it stores the normal standby flag in the EEPROM 17 (Step S42). In a case where the empty soak standby flag is stored in the EEPROM 17, the CPU 11 deletes the empty soak standby flag from the EEPROM 17 (Step S42). After the processing at any one of the Steps S42, S31, and S38, the CPU 11 terminates the recovery control after soak standby. In a case where the normal standby flag is stored in the EEPROM 17, the CPU 11 is able to perform the printing operation. In a case where the empty standby flag is stored in the EEPROM 17, the CPU 11 does not perform the printing operation.

Soak

The inventor has confirmed that under the conditions enumerated below, the cleaning liquid 92 soaks the nozzle face 111 in the soak cleaning (Steps S63, S87).

(1) The second area 662 that is shown in FIG. 2 measures 22 millimeters from left to right and 39 millimeters from front to rear, and a distance L from the nozzle face 111 to the bottom face of the second area 662 is 1.1 millimeters. In other words, a surface area S of the second area 662 in a plan view is 858 square millimeters, and a volume V of the second area 662 is 943.8 cubic millimeters.

(2) The revolution speed of the pump 905 in the soak cleaning is 300 rpm.

(3) A surface tension F of the cleaning liquid 92 is 68.5 mN/m.

Note that the first area 661 that is shown in FIG. 2 measures 6 millimeters from left to right and 39 millimeters from front to rear, and the distance L from the nozzle face 111 to the bottom face of the first area 661 is 1.1 millimeters. In other words, the surface area of the first area 661 in a plan view is 234 square millimeters, and the volume V of the first area 661 is 257.4 cubic millimeters. Accordingly, the volume V of the first area 661 is smaller than the volume V of the second area 662. Therefore, in the soak cleaning, if the cleaning liquid 92 soaks the nozzle face 111 in the second area 662 under the conditions (2) and (3), then it stands to reason that the cleaning liquid 92 will soak the nozzle face 111 in the first area 661 under the conditions (2) and (3).

Based on the confirmed results for the conditions (1) to (3) above, it is thought that in the soak cleaning, the cleaning liquid 92 will soak the nozzle face 111 under the conditions hereinafter described. Specifically, if the volumes V of the spaces within the cap 67 to which the pump 905 applies suction are reduced, the amount of the cleaning liquid 92 that is needed to fill the spaces will be reduced. Accordingly, it becomes easier for the cleaning liquid 92 to soak the nozzle face 111. Therefore, one of the surface area S and the distance L may be reduced in order to reduce the volume V. Reducing the distance L shortens the distance to the nozzle face 111, so that is desirable for soaking purposes. Soaking also becomes easier in the soak cleaning if the revolution speed of the pump 905 is not less than 300 rpm, because the suction force with which the pump 905 draws the cleaning liquid 92 into the spaces inside the cap 67 becomes stronger.

As explained previously, in the embodiment that is described above, according to the printer 1, in a case where the amount of the cleaning liquid 92 is less than the specified amount and not less than the second prescribed amount that is necessary in order to perform one round of processing for the soak cleaning of the nozzle face 111, the CPU 11 performs the soak cleaning of the nozzle face 111 (Step S72) in the empty processing (Steps S6, S8, S9) and prohibits the printing operation by storing the empty soak standby flag in the EEPROM 17 (Step S73). The possibility can thus be decreased that none of the cleaning liquid 92 will remain, making it impossible to leave the nozzle face 111 in a state of being soaked by the cleaning liquid 92. That in turn can decrease the possibility that the clogging of the nozzles 113 by hardened ink will generate adverse effects such as the failure to print some dots, the clogging of the waste liquid flow paths 771 to 778, and the like. The possibility of a decline in the print quality can be reduced accordingly. Note that if the printing operation, the purge processing, or the like is performed when the remaining amount of the ink is not greater than the first prescribed amount, there is a possibility of a decline in the print quality due to ink discharge problems and the like that are caused by an insufficient remaining amount of the ink, air bubbles in the ink, or hardening of the ink. According to the printer 1 in the embodiment that is described above, even in a case where the remaining amount of the ink is not greater than the first prescribed amount, the CPU 11 performs the soak cleaning of the nozzle face 111 (Step S72) in the empty processing (Steps S6, S8, S9) and prohibits the printing operation by storing the empty soak standby flag in the EEPROM 17 (Step S73). The prohibiting of the printing operation increases the possibility that the length of time during which the ink is not discharged from the nozzles 113 will become longer. However, because the soak cleaning of the nozzle face 111 has been performed (Step S72), the possibility can be decreased that clogging of the nozzles 113 by hardened ink will generate adverse effects the next time that printing is performed, such as the failure to print some dots, clogging of the maintenance flow path systems 800, 804 that are used for the maintenance operations, and the like.

After the soak cleaning of the nozzle face 111 (Step S72), the printing operation is prohibited, with the nozzles 113 in the covered state of being covered by the cap 67 (Step S71), and with the nozzle face 111 in the state of being soaked by the cleaning liquid 92 that has filled the cap 67.

The prohibiting of the printing operation increases the possibility that the length of time during which the ink is not discharged from the nozzles 113 will become longer. However, the nozzle face 111 is soaked by the cleaning liquid 92 that has filled the cap 67, and the nozzle face 111 is cleaned by the cleaning liquid 92. Therefore, the possibility can be decreased that clogging of the nozzles 113 by hardened ink will generate adverse effects the next time that printing is performed, such as the failure to print some dots, clogging of the maintenance flow path systems 800, 804 that are used for the maintenance operations, and the like. The possibility of a decline in the print quality can be reduced accordingly.

In the first determination processing (Step S3), in a case where the CPU 11 does not determine that the first signal has been received (NO at Step S3), and in the second determination processing (Step S4), in a case where the CPU 11 has determined that the second signal has been received (YES at Step S4), the CPU 11 performs the empty processing (Step S6). In the empty processing (Step S6), the CPU 11, without performing the normal purge (Step S62) that sucks the ink out of the nozzles 113, performs the soak cleaning of the nozzle face 111 (Step S72) and stores in the EEPROM 17 the empty soak standby flag that prohibits the performing of the printing operation (Step S73). Therefore, in a case where the amount of the ink is not less than the first prescribed amount, the purge processing is enabled, and the amount of the cleaning liquid 92 is less than the specified amount and not less than the second prescribed amount that is necessary in order to perform one round of the soak cleaning of the nozzle face 111 (YES at Step S4), the CPU 11 performs the soak cleaning of the nozzle face 111 (Step S72) without performing the normal purge (Step S62). In addition, the printing operation is prohibited (Step S73). Because the normal purge (Step S62) is not performed, the possibility can be reduced that the ink that has been sucked out by the normal purge (Step S62) will clog the flow in the waste liquid flow paths 771, 772, 774.

In a case where the amount of the ink 91 becomes not greater than the first prescribed amount (YES at Step S3), and the amount of the cleaning liquid 92 is not less than the specified amount and is not less than the second prescribed amount that is necessary in order to perform one round of the soak cleaning of the nozzle face 111 (NO at Step S7), the CPU 11 performs the empty processing (Step S8). In the empty processing (Step S8), the CPU 11, without performing the normal purge (Step S62), performs the soak cleaning of the nozzle face 111 (Step S72) and prohibits the printing operation (Step S73). Performing the normal purge (Step S62), even though the remaining amount of the ink is low, would create the possibility of a decline in the print quality due to ink discharge problems and the like that are caused by an insufficient remaining amount of the ink, air bubbles in the ink, or hardening of the ink. That possibility can be reduced by performing the soak cleaning (Step S72) without performing the normal purge (Step S62). The prohibiting of the printing operation increases the possibility that the length of time during which the ink is not discharged from the nozzles 113 will become longer. However, the CPU 11 does perform the soak cleaning of the nozzle face 111. Therefore, the possibility can be decreased that clogging of the nozzles 113 by hardened ink will generate adverse effects the next time that printing is performed, such as the failure to print some dots, clogging of the flow paths that are used for the maintenance operations, and the like.

In the first determination processing (Step S3), in a case where the CPU 11 does not determine that the first signal has been received (NO at Step S3), and in the second determination processing (Step S4), in a case where the CPU 11 does not determine that the second signal has been received (NO at Step S4), the CPU 11 performs the normal processing (Step S5). Therefore, in a case where the amount of the ink is not less than the first prescribed amount, the purge processing is enabled, and the amount of the cleaning liquid 92 is not less than the specified amount and is not less than the second prescribed amount that is necessary in order to perform one round of the soak cleaning of the nozzle face 111, the CPU 11 performs the normal purge (Step S62), then performs the soak cleaning of the nozzle face 111 (Step S63). Therefore, the nozzle face 111 is soaked after the air bubbles and hardened ink that have penetrated into the supply flow paths 711, 712 and the nozzles 113 have been removed, so the nozzles 113 can be more effectively prevented from drying out.

After performing the normal processing (Step S5), the CPU 11 performs the normal recovery processing (Step S41), which includes at least one of the normal purge (Steps S84, S86) and the flushing (Steps S83, S85). After the empty processing (Steps S6, S8, S9) is performed, in a case where the CPU 11 does not determine, in the first determination processing (Step S29), that the first signal has been received (NO at Step S29), and the CPU 11 does not determine, in the second determination processing (Step S30), that the second signal has been received (NO at Step S30), the CPU 11 performs the empty recovery processing (Step S40). In the empty recovery processing (Step S40), the CPU 11 performs at least one of the recovery purge (Step S92) and recovery flushing processing. The recovery purge (Step S92) is a purge in which the suction force that is applied to the nozzles 113 is greater than in the normal purge (Steps S62, S84, S86), or the purge is performed for a longer time. The recovery flushing processing is flushing processing in which the normal flushing processing is performed three times, at Steps S93, S95, and S97, such that a greater amount of the ink is discharged than in the normal flushing processing at Steps S83 and S85. Therefore, the possibility is increased that the air bubbles and hardened ink that have penetrated into the supply flow paths 711, 712 and the nozzles 113 will be discharged, so the possibility that the nozzles 113 will be clogged can be reduced.

After performing the empty processing (Steps S6, S8, S9), the CPU 11 determines whether the specified length of time that is based on the expiry time for the cleaning liquid 92 has elapsed (Step S21). In a case where the CPU 11 has determined that the specified length of time has elapsed (YES at Step S21), the CPU 11 displays the recommendation display, which recommends the user to perform the replacement processing that replaces the ink that is supplied to the supply flow paths 711, 712 with the filling liquid (Step S22). Therefore, even in a state in which the cleaning liquid 92 is soaking the nozzle face 111 and the performing of the printing operation is prohibited, in a case where the specified length of time that is based on the expiry time for the cleaning liquid 92 has elapsed, the recommendation display (Step S22) is able to recommend the user to replace the ink that is supplied to the head 110 and the supply flow paths 711, 712 with the filling liquid. Therefore, the replacement processing of the filling liquid is able to maintain the head 110 and the supply flow paths 711, 712 in good condition.

After the empty processing (Steps S6, S8, S9) is performed, the CPU 11 performs the circulation processing (Step S24), which circulates the ink through the first supply flow paths 711, 712 and the circulation flow paths 731, 732, even in a state in which the cleaning liquid 92 is soaking the nozzle face 111 and the performing of the printing operation is prohibited. Because the cleaning liquid 92 is soaking the nozzle face 111 and the printing operation is prohibited, there is a strong possibility that the length of time during which the ink is not discharged from the nozzles 113 will become longer. However, because the circulation processing is being performed, even if the ink contains components that are prone to sedimentation, the possibility that those components will settle out can be reduced.

After the empty processing (Steps S6, S8, S9) is performed, in a case where the CPU 11 does not determine, in the first determination processing (Step S29), that the first signal has been received (NO at Step S29), and the CPU 11 does not determine, in the second determination processing (Step S30), that the second signal has been received (NO at Step S30), the CPU 11 performs cancellation processing that cancels the prohibiting of the printing operation by storing the normal standby flag in EEPROM 17 (Step S42). In a case where the empty soak standby flag is stored in the EEPROM 17, the CPU 11 also deletes the empty soak standby flag from the EEPROM 17 (Step S42). Therefore in a case where the amount of the ink and the amount of the cleaning liquid 92 have been restored, the CPU 11 uses the cancellation processing at Step S42 to cancel the prohibiting of the printing operation, thereby enabling the printing operation. Note that until the CPU 11 determines that the amount of the ink and the amount of the cleaning liquid 92 have been restored, the printing operation is prohibited in the state in which the cleaning liquid 92 is soaking the nozzle face 111. Therefore, at the time when the printing operation is enabled, the possibility can be decreased that clogging of the nozzles 113 by hardened ink will generate adverse effects such as the failure to print some dots, clogging of the maintenance flow path systems 800, 804, and the like.

After the empty processing (Steps S6, S8, S9) is performed, in a case where the CPU 11 has determined, in the first determination processing (Step S3), that the first signal has been received (YES at Step S3), and after determining, in the second determination processing (Step S7), that the second signal has been received (YES at Step S7), the CPU 11 then does not determine in the second determination processing (Step S37), that the second signal has been received (NO at Step S37), the CPU 11 continues to prohibit the printing operation (Step S31). Therefore, in a case where only the amount of the cleaning liquid 92 has been restored, and the amount of the ink has not been restored, the printing operation continues to be prohibited, so it is possible to prevent printing of diminished quality from being performed. Furthermore, if the printing operation continues to be prohibited, purging is not performed. This makes it possible to prevent the meniscus from being destroyed, which is what would happen if the purging were to be performed even though the remaining amount of the ink is low.

The present invention is not limited to the embodiment that is described above, and various types of modifications can be made. For example, the first signal and the second signal are not limited to being ON signals and may also be OFF signals. The reference time H in the determination processing at Step S2 is not limited to eight hours and may be set to any time that matches the properties of the ink. The first prescribed amount is not limited to being 1.5 cubic centimeters, which is the amount of the ink that is required for one round of the purge processing, or to being 100 cubic centimeters, the amount of the ink in the near-empty state. The first prescribed amount needs only to be not less than the amount of the ink that is required for one round of the purge processing. The standard for the determination of YES in the determination processing at Step S3 may also be that the purge processing has been performed a specified number of the times after the receiving of the first signal. For example, the CPU 11 may make the determination of YES after the purge processing has been performed twenty times after the receiving of the first signal.

The second prescribed amount is not necessarily limited to being 6.6 cubic centimeters, and it needs only to be the amount of the cleaning liquid 92 that is necessary in order to perform one round of the soak cleaning processing. The specified amount of the cleaning liquid 92 is not limited to being one-third of the amount of the cleaning liquid 92 when the cleaning liquid tank 705 is full. It may also be one-half, one-fourth, or the like. The specified amount of the cleaning liquid 92 is also not limited to being 300 cubic centimeters and may also be 400 cubic centimeters, 200 cubic centimeters, 100 cubic centimeters, or the like. The specified amount of the cleaning liquid 92 is also not limited to being the amount that is required for twenty rounds of the soak cleaning processing to be performed, and it may also be the amount that is required for five, ten, or thirty rounds or the like of the soak cleaning processing to be performed. The specified length of time in the determinations at Steps S21 and S41 is not limited to being sixteen weeks. The specified length of time needs only to be based on the expiry time for the cleaning liquid 92. The specified length of time in the determination at Step S25 is not limited to being eighteen hours. It only needs to be set in accordance with the properties of the ink.

The circulation command and the command to perform the recovery processing are not limited to being input from the operation buttons 52 of the printer 1, and they may also be input from a PC (not shown in the drawings) that is connected to the printer 1. The display to replace the ink with the filling liquid (Step S22) and the cartridge agitation warning display (Step S26) are not limited to being displays on the display 50, and they may also be displays on a display (not shown in the drawings) of a PC (not shown in the drawings) that is connected to the printer 1. In FIGS. 4 and 5, the cleaning liquid tank 705 and the waste liquid tank 706 are each drawn as two separate tanks for the sake of simplicity, but each may also be a single tank. The partition wall 673 may also be omitted from the cap 67. In that case, the first area 661 and the second area 662 would also cease to exist, so it would be possible to supply the cleaning liquid 92 into the interior of the cap 67 only once, and to remove the cleaning liquid 92 only once. The number of the partition walls 673 is also not limited. For example, three of the partition walls 673 may be provided in the cap 67, and they may contact the corresponding boundaries between the plurality of the nozzle arrays 121 to 124. It is also acceptable not to provide the partition wall 673. In that case, it would also not be necessary to provide both the first flow path system 701 and second flow path system 702, and a single flow path system would be preferable.

In the empty recovery processing that is shown in FIG. 13, as the recovery flushing processing, the normal flushing processing is performed three times, at Steps S93, S95, and S97, such that a greater amount of the ink is discharged than in the normal flushing processing at Steps S83 and S85. The recovery flushing processing is not limited to this pattern, and all that is required is that a greater amount of the ink be discharged in one round of flushing than in the normal flushing processing at Steps S83 and S85. In the empty recovery processing that is shown in FIG. 13, all that is required is for at least one of the recovery purge (Step S92) and the recovery flushing processing to be performed.

It is also acceptable not to provide the waste liquid on-off valves 781, 782. It is also acceptable not to provide the waste liquid tank 706. The ink that is discharged from the nozzles 113 may also be a discharge agent that decolorizes a dyed cloth, for example. The opposite end of the gas flow path 873 from the cap 67 is open to the atmosphere, but it may also be connected to a tank that stores a gas other than air, for example. A gas flow path may also be connected to each one of the supply flow paths 815, 816, and an air on-off valve may be provided in each one of the gas flow paths.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device comprising:

a head provided with a nozzle face in which is disposed a nozzle configured to discharge an ink;

an ink storage portion storing the ink, the ink storage portion being connected to the head through an ink supply path;

a remaining ink amount detector configured to detect a remaining amount of the ink stored in the ink storage portion;

a cap configured to contact the nozzle face and cover the nozzle;

a cleaning liquid storage portion configured to store a cleaning liquid for cleaning the nozzle face, the cleaning liquid storage portion being connected to the cap through a cleaning liquid supply flow path;

a remaining cleaning liquid amount detector configured to detect a remaining amount of the cleaning liquid stored in the cleaning liquid storage portion;

a waste liquid flow path connected to the cap and configured to drain off the cleaning liquid supplied to the inside of the cap;

a processor; and a memory storing computer-readable instructions which, when executed by the processor, cause the processor to:

perform first determination processing that determines whether a first signal has been received from the remaining ink amount detector, the first signal indicating that the remaining amount of the ink is not greater than a first prescribed amount, perform second determination processing that determines whether a second signal has been received from the remaining cleaning liquid amount detector, the second signal indicating that the amount of the remaining cleaning liquid is less than a specified amount and is not less than a second prescribed amount that is necessary in order to perform one round of nozzle face soak cleaning processing, in which, with the cap in a covering state in which it covers the nozzle face, the cleaning liquid is put into a state in which it fills the cap and soaks the nozzle face, and perform empty processing that, in at least one of a case where the first determination processing has determined that the first signal has been received, and a case where the second determination processing has determined that the second signal has been received, performs the nozzle face soak cleaning processing and performs print prohibition processing, that prohibits a printing operation, wherein the memory further stores computer-readable instructions which, when executed by the processor, in a case where the first determination processing has not determined that the first signal has been received and the second determination processing has determined that the second signal has been received, cause the processor to perform the empty processing by performing the nozzle face soak cleaning processing and the print prohibition processing without performing purge processing that performs suctioning of the ink out of the nozzle.

2. The print device according to claim 1, wherein the memory further stores computer-readable instructions, when executed by the processor, cause the processor to perform the empty processing by performing the nozzle face soak cleaning processing and the print prohibition processing that is performed with the cap in the covering state and the cleaning liquid in the state in which it has filled the cap and is soaking the nozzle face.

3. The print device according to claim 1, wherein the memory further stores computer-readable instructions, when executed by the processor, in a case where the first determination processing has determined that the first signal has been received and the second determination processing has not determined that the second signal has been received, cause the processor to perform the empty processing by performing the nozzle face soak cleaning processing and the print prohibition processing, without performing purge processing, which performs suctioning of the ink from the nozzle.

4. The print device according to claim 1, wherein the memory further stores computer-readable instructions, when executed by the processor, in a case where the first determination processing has not determined that the first signal has been received and the second determination processing has not determined that the second signal has been received, cause the processor to perform normal processing that performs purge processing, that performs suctioning of the ink out of the nozzle, and performs the nozzle face soak cleaning processing.

5. The print device according to claim 4, wherein the memory further stores computer-readable instructions, when executed by the processor, cause the processor to:

perform normal recovery processing after the normal processing is performed, the normal recovery processing including at least one of normal purge processing and normal flushing processing, and perform empty recovery processing after the empty processing is performed, the empty recovery processing including at least one of recovery purge processing, in which the force of suctioning from the nozzle is greater than in the normal purge processing, or the suction is performed for a longer time than in the purge processing, and recovery flushing processing, in which a greater amount of the ink is discharged than in the normal flushing processing, the empty recovery processing being performed in a case where the first determination processing has not determined that the first signal has been received and the second determination processing has not determined that the second signal has been received.

6. The print device according to claim 1, wherein the memory further stores computer-readable instructions, when executed by the processor, cause the processor to:

perform time determination processing that determines whether a specified length of time that is based on an expiry time of the cleaning liquid has elapsed since the empty processing was performed, creating a state in which the printing operation is prohibited, and perform display processing that, when the time determination processing has determined that the specified length of time has elapsed, displays a recommendation display that replacement processing be performed to replace the ink that is supplied to the ink supply path with filling liquid.

7. The print device according to claim 1, further comprising:

a circulation flow path, one end of which is connected to one of the ink storage portion and the ink supply path and the other end of which is connected to one of the head and the ink supply path, wherein the memory further stores computer-readable instructions, when executed by the processor, cause the processor to:

perform circulation processing that circulates the ink through the ink supply path and the circulation flow path, even after the empty processing has been performed and created a state in which the printing operation is prohibited.

8. The print device according to claim 1, wherein the memory further stores computer-readable instructions, when executed by the processor, cause the processor to:

perform cancellation processing that, after the empty processing has been performed, cancels the prohibiting of the printing operation when the first determination processing has not determined that the first signal has been received and the second determination processing has not determined that the second signal has been received.

9. The print device according to claim 6, wherein the memory further stores computer-readable instructions, when executed by the processor, cause the processor to:

perform the replacement processing in a case where, after the first determination processing has determined that the first signal has been received and the second determination processing has determined that the second signal has been received, the first determination processing does not determine, after the empty processing has been performed, that the first signal has been received, such that the prohibiting of the printing operation is continued, and filling liquid determination processing that determines whether the filling liquid can be supplied, has determined that the filling liquid can be supplied.

10. The print device according to claim 1, wherein the memory further stores computer-readable instructions, when executed by the processor, cause the processor to continue the prohibiting of the printing operation in a case where, after the first determination processing has determined that the first signal has been received and the second determination processing has determined that the second signal has been received, the second determination processing does not determine, after the empty processing has been performed, that the second signal has been received.

11. A non-transitory computer-readable medium storing computer-readable instructions which are executed by a processor of a print device provided with a head provided with a nozzle face in which is disposed a nozzle configured to discharge an ink, an ink storage portion storing the ink, the ink storage portion being connected to the head through an ink supply path, a remaining ink amount detector configured to detect a remaining amount of the ink stored in the ink storage portion, a cap configured to contact the nozzle face and covering the nozzle, a cleaning liquid storage portion configured to store a cleaning liquid for cleaning the nozzle face, the cleaning liquid storage portion being connected to the cap through a cleaning liquid supply flow path, a remaining cleaning liquid amount detector configured to detect a remaining amount of the cleaning liquid stored in the cleaning liquid storage portion, and a waste liquid flow path connected to the cap and capable of draining off the cleaning liquid supplied to the inside of the cap, the processor being configured to control the print device, and the computer-readable instructions, when executed by the processor, cause the processor to:

perform first determination processing, which determines whether a first signal has been received from the remaining ink amount detector, the first signal indicating that the remaining amount of the ink is not greater than a first prescribed amount, perform second determination processing, that determines whether a second signal has been received from the remaining cleaning liquid amount detector, the second signal indicating that the amount of the remaining cleaning liquid is less than a specified amount and is not less than a second prescribed amount that is necessary in order to perform one round of nozzle face soak cleaning processing, in which, with the cap in a covering state in which it covers the nozzle face, the cleaning liquid is put into a state in which it fills the cap and soaks the nozzle face, and perform empty processing, that, in at least one of a case where the first determination processing has determined that the first signal has been received, and a case where the second determination processing has determined that the second signal has been received, performs the nozzle face soak cleaning processing and performs print prohibition processing, that prohibits a printing operation, wherein the computer-readable instructions, in a case where the first determination processing has not determined that the first signal has been received and the second determination processing has determined that the second signal has been received, cause the processor to perform the empty processing by performing the nozzle face soak cleaning processing and the print prohibition processing without performing purge processing that performs suctioning of the ink out of the nozzle.

* * * * *